US009234374B2

(12) United States Patent
Wolf et al.

(10) Patent No.: US 9,234,374 B2
(45) Date of Patent: Jan. 12, 2016

(54) INTEGRATED LOCK AND LATCH DEVICE FOR SLIDING WINDOWS

(71) Applicant: Truth Hardware Corporation, Owatonna, MN (US)

(72) Inventors: Glen M. Wolf, Owatonna, MN (US); Edward J. Subliskey, Mountain Top, PA (US); David Lee Snyder, Glenville, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

(21) Appl. No.: 13/733,674

(22) Filed: Jan. 3, 2013

(65) Prior Publication Data

US 2013/0214545 A1 Aug. 22, 2013

Related U.S. Application Data

(60) Provisional application No. 61/582,609, filed on Jan. 3, 2012, provisional application No. 61/600,496, filed on Feb. 17, 2012.

(51) Int. Cl.
*E05C 3/04* (2006.01)

(52) U.S. Cl.
CPC ..... *E05C 3/046* (2013.01); *Y10T 292/1041* (2015.04)

(58) Field of Classification Search
CPC ..... Y10S 292/20; Y10S 292/47
USPC ..... 292/241, DIG. 20, DIG. 47; 70/89, 90; 49/449
See application file for complete search history.

(56) References Cited

U.S. PATENT DOCUMENTS

| | | | | | |
|---|---|---|---|---|---|
| 362,152 | A * | 5/1887 | Ferren | 292/210 |
| 406,234 | A * | 7/1889 | Pruitt | 292/218 |
| 412,430 | A * | 10/1889 | Swab | 49/320 |
| 462,183 | A * | 10/1891 | Varney | 292/280 |
| 1,105,100 | A * | 7/1914 | Rasmussen | 292/241 |
| 1,834,194 | A * | 12/1931 | Wirt | 292/204 |
| 2,274,854 | A * | 3/1942 | Stewart | 292/160 |
| 2,766,492 | A * | 10/1956 | Day et al. | 49/119 |
| 4,848,811 | A * | 7/1989 | Laufenburg et al. | 292/142 |
| 4,962,652 | A * | 10/1990 | Schneider | 70/89 |
| 5,253,903 | A * | 10/1993 | Daley | 292/39 |
| 5,253,917 | A * | 10/1993 | Brueggemann | 296/218 |
| 5,653,485 | A * | 8/1997 | Campbell | 292/241 |
| 5,715,631 | A * | 2/1998 | Kailian et al. | 49/450 |
| 6,076,304 | A * | 6/2000 | Carrier | 49/342 |
| 7,000,957 | B2 * | 2/2006 | Lawrence | 292/241 |

(Continued)

*Primary Examiner* — Kristina Fulton
*Assistant Examiner* — Faria Ahmad
(74) *Attorney, Agent, or Firm* — Patterson Thuente Pedersen, P.A.

(57) ABSTRACT

An integrated lock and latch device for use in sliding sash windows includes a lock assembly including a sweep cam that has a pinion portion adjacent and extending downwardly from it. The pinion portion presents gear teeth extending outwardly. A tilt latch assembly including a sliding bolt is biased toward an extended position where a terminal portion of the sliding bolt extends outwardly. The sliding bolt has at least one track portion. The sweep cam is rotatably shiftable between a locked position where the sweep cam is engaged to the keeper, an intermediate unlocked position where the sweep cam is disengaged from the keeper and a tilt position where the sweep cam is disengaged from the keeper and the first gear teeth are engaged to the second gear teeth and the sliding bolt is withdrawn inwardly from the extended position.

10 Claims, 42 Drawing Sheets

(56) References Cited

U.S. PATENT DOCUMENTS

| | | | | |
|---|---|---|---|---|
| 7,017,957 | B2 * | 3/2006 | Murphy et al. | 292/241 |
| 7,036,274 | B2 * | 5/2006 | Carrier | 49/394 |
| 7,070,215 | B2 * | 7/2006 | Kelley et al. | 292/241 |
| 7,322,619 | B2 * | 1/2008 | Nolte et al. | 292/175 |
| 7,481,470 | B2 * | 1/2009 | Eenigenburg et al. | 292/241 |
| 7,490,873 | B1 * | 2/2009 | Ricke et al. | 292/5 |
| 7,963,577 | B2 * | 6/2011 | Wolf | 292/241 |
| 8,020,904 | B2 * | 9/2011 | Flory et al. | 292/241 |
| 8,132,369 | B2 * | 3/2012 | Pettit et al. | 49/449 |
| 8,181,393 | B2 * | 5/2012 | Talpe | 49/394 |
| 8,205,919 | B2 * | 6/2012 | Flory | 292/241 |
| 8,205,920 | B2 * | 6/2012 | Flory | 292/241 |
| 2002/0145291 | A1 * | 10/2002 | Goldenberg et al. | 292/241 |
| 2003/0205903 | A1 * | 11/2003 | Kelley et al. | 292/241 |
| 2004/0026932 | A1 * | 2/2004 | Coleman et al. | 292/241 |
| 2004/0036299 | A1 * | 2/2004 | Goldenberg et al. | 292/241 |
| 2005/0210934 | A1 * | 9/2005 | Chao et al. | 70/90 |
| 2006/0244270 | A1 * | 11/2006 | Rotondi | 292/213 |
| 2007/0046031 | A1 * | 3/2007 | Goldenberg et al. | 292/5 |
| 2007/0205615 | A1 * | 9/2007 | Eenigenburg et al. | 292/241 |
| 2008/0012358 | A1 * | 1/2008 | Liang et al. | 292/241 |
| 2009/0079202 | A1 * | 3/2009 | Wolf | 292/36 |
| 2009/0189398 | A1 * | 7/2009 | Lawrence | 292/241 |
| 2010/0218425 | A1 * | 9/2010 | Nolte et al. | 49/185 |
| 2014/0259940 | A1 * | 9/2014 | Meves et al. | 49/350 |

* cited by examiner

INTEGRATED LOCK AND LATCH DEVICE FOR SLIDING WINDOWS

RELATED APPLICATIONS

This application claims the benefit of U.S. Provisional Patent Application No. 61/582,609 filed Jan. 3, 2012, and entitled INTEGRATED LOCK AND LATCH DEVICE FOR SLIDING WINDOWS, and also claims the benefit of U.S. Provisional Patent Application No. 61/600,496, filed Feb. 17, 2012, and entitled INTEGRATED LOCK AND LATCH DEVICE FOR SLIDING WINDOWS, both said applications being fully incorporated herein by reference.

FIELD OF THE INVENTION

The invention generally relates to an integrated lock and latch device for sliding windows. More particularly, the invention relates to a lock and latch device which also actuates a separate tilt latching mechanism.

BACKGROUND OF THE INVENTION

Sliding window manufacturers typically use locking devices on double-hung sashes on the sash meeting rails to provide environmental control and security and to prevent unintended opening of the windows. In addition, double-hung windows are typically equipped with separate tilt latching devices to allow the sash to be tilted away from the window jamb frame for cleaning of exterior glazing or for other purposes. Generally, the sashes tilt inwardly at the top. Some horizontally sliding windows may include a similar arrangement as well. Placement of the tilt latching devices actuators on the sash meeting rails creates a visible obstruction and can detract from the aesthetic properties of the double-hung window. Accordingly, there is still room for improvement in the double-hung window lock and latch arts.

For the purposes of this application, "locking" and like terms refer to the act of immobilizing a first sash relative to a second sash in order that the window is closed with the meeting rails of the two sashes adjacent each other and secured to each other by the locking mechanism. "Latching" refers to securing the sash in sliding relation to the window frame so that the sash is parallel to the jamb in which the sash slides. An "unlatched" sash is free to be moved away from the jamb by tilting the sash relative to the jamb.

SUMMARY OF THE INVENTION

Embodiments of the invention solve many of the above-referenced problems by accomplishing both the functions of locking and unlocking the window, as well as tilt-latching, by locating a lock device cooperatively with a latch device contained within the sash lock rail to eliminate the visible latching device actuators.

An exemplary embodiment includes at least one lock assembly adapted for mounting in a window sash frame that can be shifted between locked, unlocked and tilt latch retracting positions, all of which are actuated by movement of a single rotating lever handle or knob. The lock assembly interacts with at least one keeper which is adapted for mounting in an abutting window sash to secure the window sashes in a closed and locked position relative to one another. The lock assembly is aligned with and operably connected to the latch assembly and adapted for mounting in window sash. The lock assembly has an actuator feature on its locking sweep cam which interacts with mating actuator features on the tilt latch bolt when sweep cam is moved between the locked, unlocked and tilt positions. The locking device can be adapted to work in a variety of window applications requiring a variety of lock setback distances from the window sash side edge by providing the tilt latch bolt with at least two engagement positions in the tilt latch bolt design.

An integrated lock and latch device, according to one exemplary embodiment, generally includes a lock assembly, a tilt-latch assembly and a keeper. The lock assembly and tilt-latch assembly are adapted to be secured to a first window sash while the keeper is secured to a second adjacent window sash. According to an exemplary embodiment, the lock assembly is mounted to the top lock rail of a window's inner sash and is generally aligned with the keeper which is secured to the outer sash when the sashes close the window. The lock assembly generally includes a housing, a lever handle, a locking sweep cam and a biasing detent spring. The lever handle is coupled to the cam by a shaft and, when actuated, rotates the cam within the housing to lock, unlock and tilt positions. The rotating sweep cam generally has a locking feature which engages with the keeper as the cam is rotated from the unlocked to the locked position. Engagement of the sweep cam with the keeper secures the window in the locked position.

According to an exemplary embodiment, the sweep cam is biased toward its locked and unlocked positions by the biasing spring. The rotating sweep cam includes at least one pinion gear feature which interacts with the latch bolt in the latch assembly as the cam is rotated from the unlocked position to the tilt position. According to an exemplary embodiment, the lock housing has at least one alignment feature that engages a feature of the tilt latch assembly to facilitate positive alignment of the lock to the latch assembly in the window sash rail.

The latch assembly can be mounted within the lock rail of the inner sash and is generally aligned with both the lock assembly and a side jamb frame opening. The latch assembly includes a sliding bolt coupled to a biasing spring within a structural housing. The spring biases the latch bolt to extend outwardly past the window sash side stile surface such that the latch bolt engages with the side jamb frame opening to prevent unintended tilting of the window sash relative to the window frame. The structural housing includes at least one flange on one end that abuts the window sash side stile to prevent the housing from retracting along with the bolt during functioning of the bolt as the bolt is drawn inward during the tilt function. The entire latch assembly is structured to be inserted into the passage via the hole in the window sash side stile without fasteners, snap features or other types of retention features as the bias of the latch spring between the bolt and the housing prevents the housing from coming out of the sash side style.

At least one series of rack gears is present on the bolt and arranged to interface with the lock sweep cam gear as the lever handle and cam are rotated from the unlocked position to the tilt position thereby retracting the bolt. Once the latch bolt is retracted, the window sash is free to be tilted away from the side jamb frame for external surface cleaning or other purposes. When the lever handle is released, the latch biasing spring causes the latch bolt to return to its extended position and also rotates the locked spring cam and the lever handle back to the unlocked position.

The keeper, according to an exemplary embodiment of the invention, can be mounted on an interior side of the window's outer sash and is generally positioned to be aligned with the lock assembly. The keeper includes a boss feature which interfaces with the lock assemblies sweep cam as the sweep cam is rotated after closure of the window sashes, when rotation of the lock's lever handle from the unlocked to locked position is actuated.

In a window having a hollow sash structure, such as a window wherein the sash is formed from aluminum or vinyl extrusions, an interior insert shaped to accept the tilt latch assembly aids in alignment and provides structural support for the lock and latch within the window sash. The interior insert may be an extrusion including a sash member conforming portion and a tilt latch conforming portion. The sash member conforming portion is shaped generally to conform to the interior shape of the sash member into which it will be inserted. The tilt latch conforming portion generally conforms to the exterior shape of the tilt latch assembly and is placed to support the tilt latch assembly adjacent to and in desired alignment with the lock assembly.

According to an exemplary embodiment, the integrated lock and latch device uses two lock points on the window sash meet rails to lock the inner window sash to the outer window sash and two tilt latch points on the vertical side window jamb frame.

Another exemplary embodiment accomplishes both the window locking and latching functions by locating the lock device in cooperation with a latch device which is contained within the sash lock rail to eliminate visible latching devices.

According to an embodiment, the device includes at least one lock assembly that is adapted for mounting in a window frame which is moveable between a locked and unlocked and a tilt latch retract position all actuated by a rotating lever handle. The lock assembly interacts with at least one keeper adapted for mounting in a window sash to secure the window in a closed and locked position. The lock assembly is aligned and connected to the latch assembly which is adapted for mounting in a window sash. The lock assembly may include an actuator feature on the locking cam which interacts with a mating actuator feature on the drive member that is coupled to the tilt latch bolt when the lock is transitioned from the unlocked to the tilt position.

According to an embodiment, the locking device is adaptable to be used in a variety of window applications requiring multiple set-back distances from the window sash side edge by including a linking member in the tilt assembly which can be provided in variable lengths to provide for variable set-back distances. The device can include a pivot feature in the linking member in the tilt latch assembly to permit the device to work in a variety of window applications.

The lock and latch device may be adapted for use within a window application in which there is no vertical or horizontal support for the tilt latch assembly to align the latch assembly with the lock assembly within the window sash profile, by including a caged component that interfaces with the lock and latch assembly to provide necessary horizontal and vertical support.

An embodiment includes two main assembly components and two independent components, including a lock assembly, a tilt latch assembly, a tilt latch support cage and a keeper. An exemplary embodiment includes at least one lock assembly adapted for mounting in a window sash frame that can be shifted between locked, unlocked and tilt latch retracting positions, all of which are actuated by movement of a single rotating lever handle or knob. The lock assembly interacts with at least one keeper which is adapted for mounting in an abutting window sash to secure the window sashes in a closed and locked position relative to one another. The lock assembly has an actuator feature on its locking sweep cam which interacts with mating actuator features on the tilt latch bolt when the sweep cam is moved between the locked, unlocked and tilt positions.

The lock assembly may be mounted to the top lock rail of a window inner sash generally registered with a keeper secured to the outer sash when the sash closes the window. The lock assembly generally includes a housing, a lever handle, a locking sweep cam and a biasing detent spring. The lever handle is coupled to the cam by a shaft and when actuated, rotates the cam within the housing to the locked, unlocked and tilt positions. The rotating sweep cam generally has a locking feature which engages with a keeper as the cam is rotated from the unlocked to the locked position. The engagement of the sweep cam with the keeper secures the window in the locked position.

The sweep cam can be biased toward its locked and unlocked positions by the use of a biasing spring interacting with the sweep cam. The rotating sweep cam includes at least one pinion gear feature which interacts with the drive member of the latch assembly as the cam is rotated from the unlocked position to the tilt position.

The latch assembly may be mounted within the lock rail of the window inner sash generally registered with both the lock assembly and the side jamb frame opening. The latch assembly has a sliding bolt located with a biasing spring, within a structural bolt housing. The spring biases the latch bolt toward an extended position, wherein the latch bolt extends out past the window sash side stile surface. The latch bolt, when extended, engages within the side jamb frame opening or openings to prevent unintended tilting of the window sash from the window frame.

The latch bolt housing may include at least one flange on one end that abuts against the window sash side stile to prevent the housing from retracting into the stile along with the bolt when the tilt function is actuated. The latch bolt housing, according to an exemplary embodiment, includes at least one retaining tab that engages with the interior wall of a drilled or routed passage in the sash side stile when the latch assembly is installed in the sash. The latch bolt, according to an exemplary embodiment, includes a retaining tab feature that keeps the bolt assembled to the latch housing once it is inserted into the housing.

Further, the latch assembly may include a linking member assembled to the latch bolt and that extends to, and is connected with, a drive member. The linking member may be a round steel wire, or may be other shapes and configurations, and can be formed from a variety of shapes and materials. The drive member may include a series of gear cog positions that interfaces with the lock's cam as the lever handle and the sweep cam are rotated from the unlocked position to the tilt position. Such action retracts the drive member, and subsequently the latch bolt, through the linking member. The entire latch assembly can be inserted into a hole in the window sash side stile and snapped in with the retaining tab feature to help retain the latch assembly.

With the latch bolt retracted, the window sash is free to be tilted out of the side jamb frame inwardly for cleaning or other purposes that require access to the exterior of the window. When the lever handle is released, the latch bolt biasing spring causes the bolt to return to the extended position and at the same time rotates the locks sweep cam and lever handle back to the unlocked position because of the connection between the linking and the drive members.

The keeper is generally mounted on an interior side of the windows outer sash in general registration with the lock assembly. The keeper generally includes a boss feature which accepts or receives the lock assembly sweep cam as the sweep cam is rotated after closure of the meeting window sashes and during rotation of the lock lever handled from the unlocked to the locked position.

In an embodiment, the window includes an interior cage insert shaped to accept the tilt latch assembly to aid alignment and to provide structural support for the lock and latch within the window sash. The window may have internal features within the sash profile that provide the necessary horizontal and vertical support and alignment for the lock and latch assembly.

According to an embodiment, the window may include a cage component inserted therein to provide horizontal and vertical support and alignment for the lock and latch assembly. This cage may include an opening for the drive member to fit into, that provides both horizontal and vertical support and alignment. The cage may include at least one snap feature which allows the cage to be pushed down vertically within a routed hole in the sash lock rail.

The snap feature can include several teeth opposing the cage from being slid out of the routed hole once assembled. The serrated teeth grip the interior of the routed hole and resist removal of the cage. Also, the cage may include horizontal flanges to prevent it from falling into the routed hole in the sash. The snap feature may provide for retention of the cage both in the vertical and horizontal orientations. The lock assembly may be fit within and over the top of the cage with vertical bosses of the lock housing pressing against the internal side walls of the cage to provide additional resistance to the cage being removed. Two lock points on the window sash meet rails and two tilt latch points on the vertical side window jamb frames may be provided when the device is used in a double-hung window.

The disclosed devices can be formed from metal, plastic composite, plastics or other materials known to those skilled in the art. The disclosed devices can be used with window sashes formed from vinyl, plastic, aluminum, wood, composite and other window sash materials.

BRIEF DESCRIPTION OF THE DRAWINGS

The embodiments of the present invention may be more completely understood in consideration of the following detailed description of various embodiments in connection with the accompanying drawings, in which.

Figure 1:
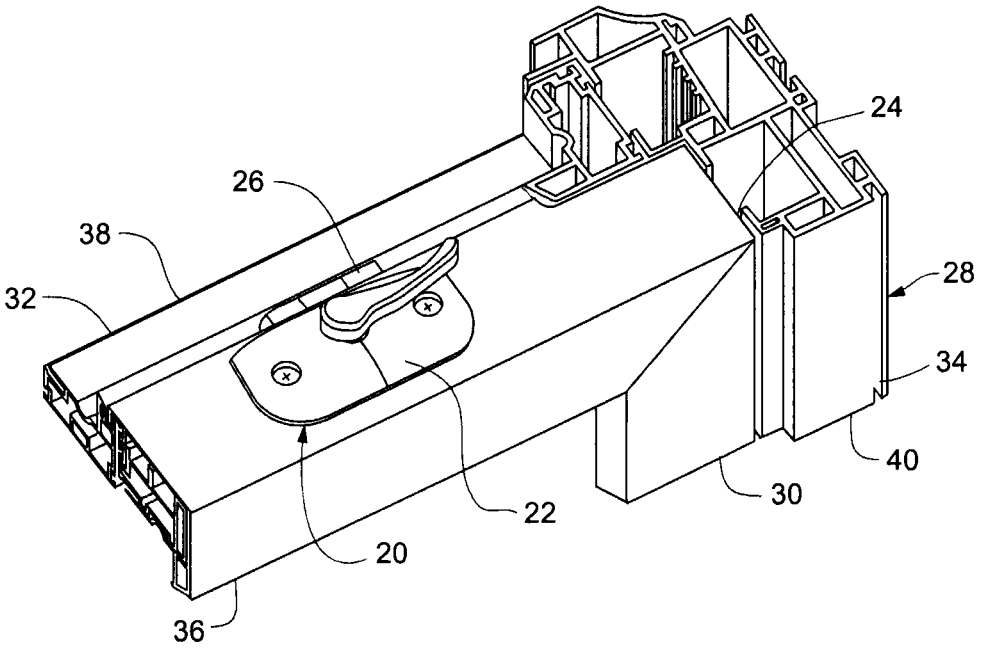
FIG. 1 is an isometric view of an integrated lock and latch device mounted in a window sash in the locked orientation according to a first embodiment.
Figure 1A:
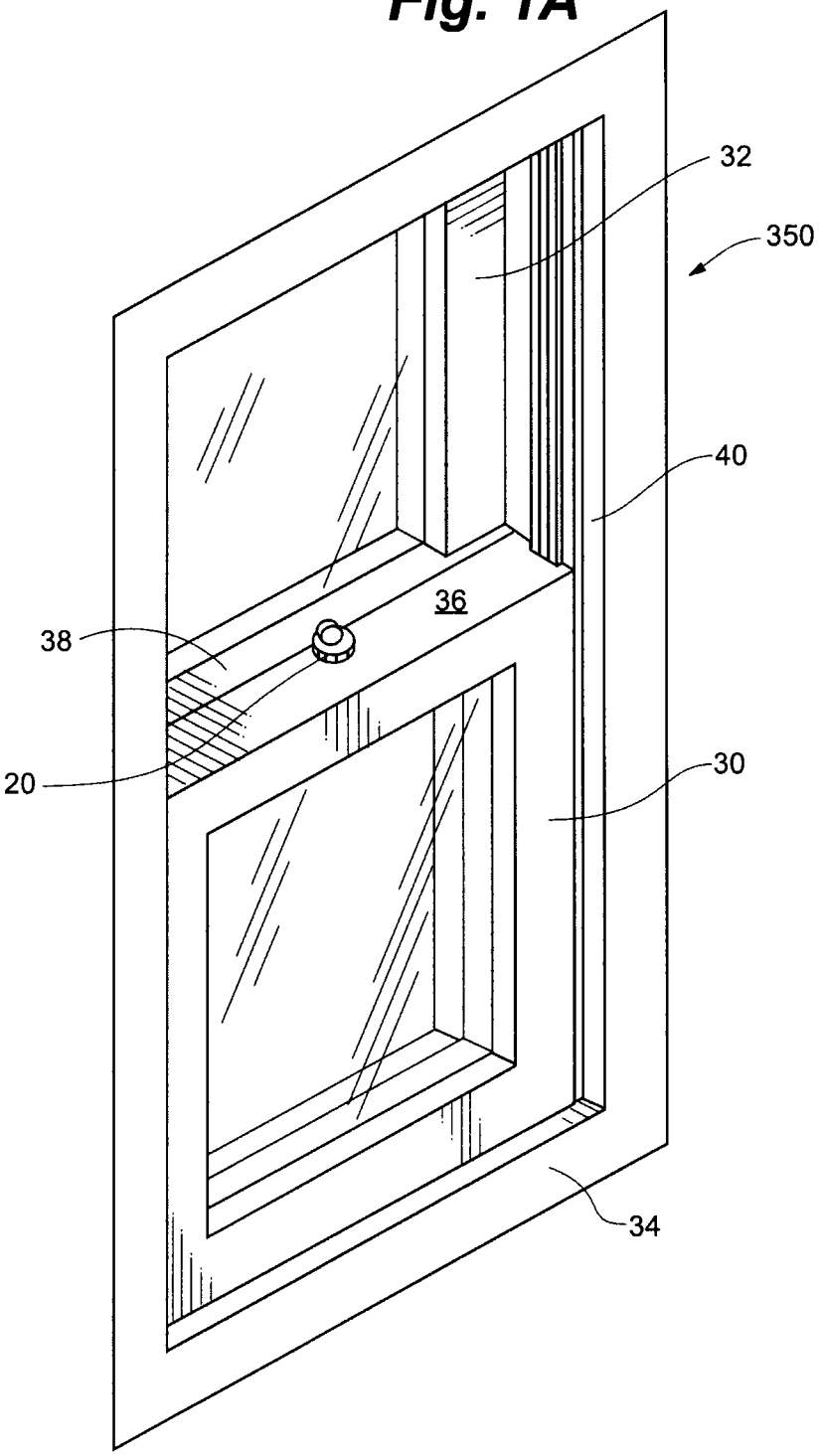
FIG. 1A is an isometric view of a double-hung window with an integrated lock and latch device as disclosed herein.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

As depicted in FIGS. 1-10, integrated lock and latch device 20 according to a first embodiment of the present invention generally includes lock assembly 22, tilt latch assembly 24 and keeper 26. Integrated lock and latch device 20 is adapted to be used in a double-hung window 350, generally including inner sash 30, outer sash 32 and frame 34. Integrated lock and latch device 20 is adapted to be used in other sliding sash windows as well. Inner sash 30 and outer sash 32 are slidably engaged with frame 34. In this exemplary embodiment, inner sash 30 includes lock rail 36 at a top thereof and outer sash 32 includes lock rail 38 at a lower edge thereof. Frame 34 also presents side jamb 40.

Referring particularly to FIGS. 5-8, lock assembly 22 generally includes housing 42 and sweep cam assembly 44.

Figure 8:
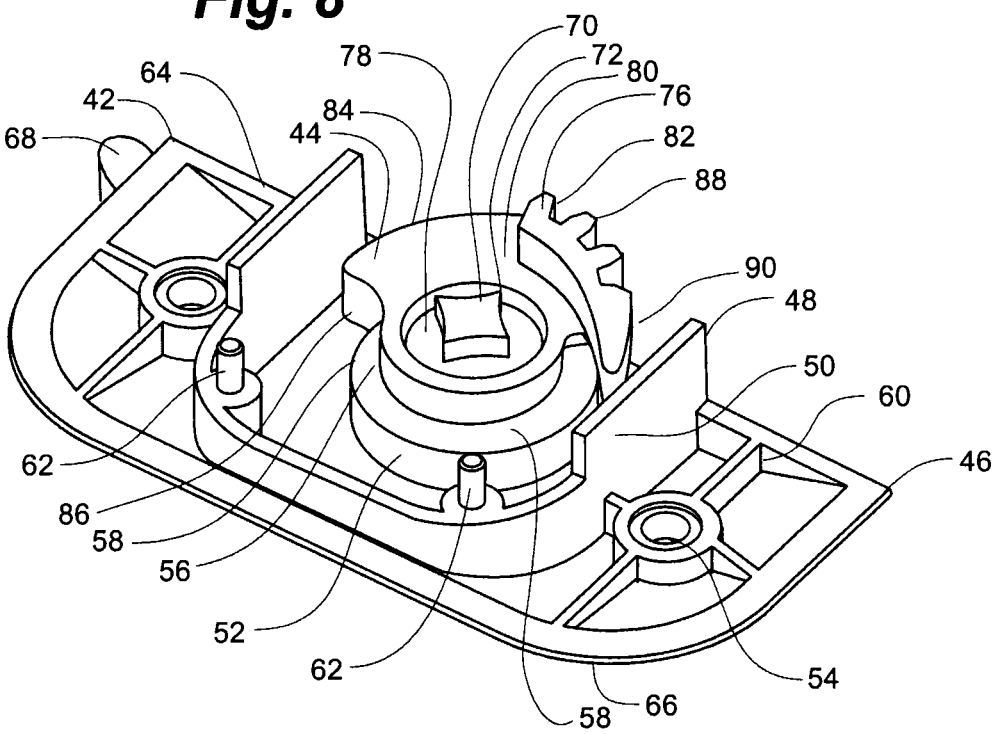
FIG. 8 is a bottom isometric view of the actuator portion of the lock assembly of FIG. 1.
Figure 9:
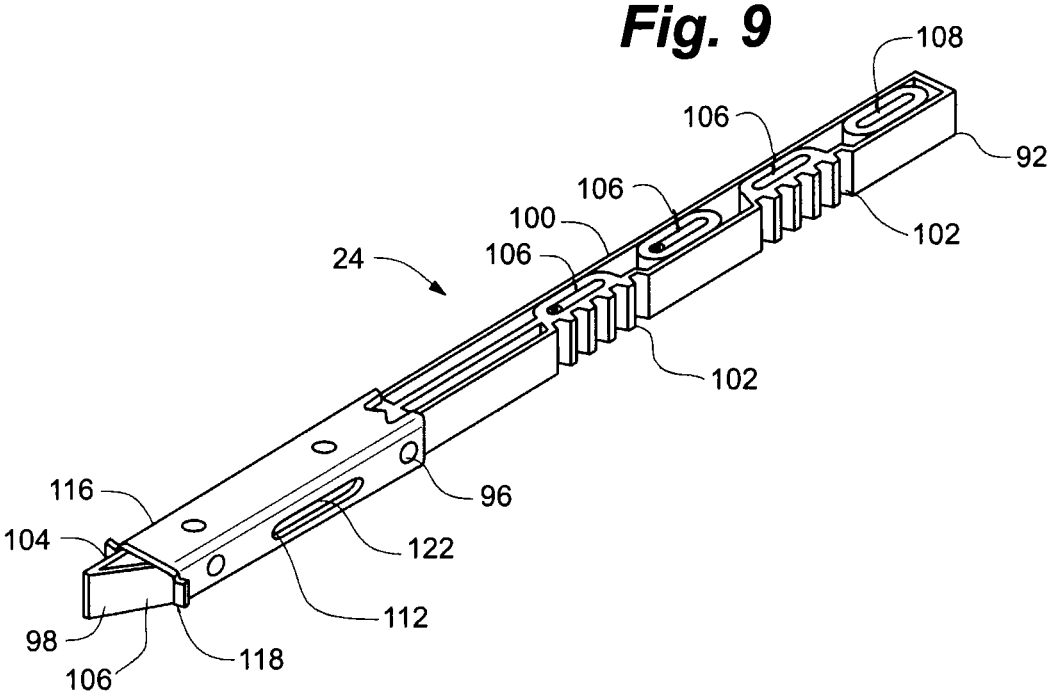
FIG. 9 is an isometric view of the latch assembly of the device of FIG. 1.

Referring particularly to FIG. 8, housing 42 is a generally unitary structure including mounting plate 46, bosses 48, wall 50 and sweep cam support 52. As can be seen, bosses 48 and wall 50 extend downwardly from mounting plate 46. Sweep cam support 52 has a generally annular structure and also extends downwardly from mounting plate 46. Mounting plate 46 presents fastener holes 54 for receiving fasteners such as screws (not shown).

Sweep cam support 52 partially encloses detent spring 56. Sweep cam support 52 presents detent spring notches 58 into which detent spring 56 fits. Mounting plate 46 may be formed as a casting or molding and may present reinforcing ridges 60 on a bottom side thereof.

Wall 50 may present alignment pegs 62. Housing 42 may include flat edge 64 and curved edge 66 forming its perimeter.

Sweep cam assembly 44 generally includes handle 68, shaft 70 and sweep cam 72. Handle 68 is coupled to sweep cam 72 by shaft 70. In the depicted exemplary embodiment, shaft 70 passes through mounting plate 46 and within sweep cam support 52. Shaft 70 has a generally square cross section. Handle 68 is generally conventional in design and may be formed as an integral structure with shaft 70. Shaft 70, viewed in cross section, may present concave faces 74 or have a truly square cross section.

Referring particularly to FIGS. 5-8, sweep cam 72 generally includes body 76, presenting shaft portion 78, cam portion 80 and pinion portion 82. Shaft portion 78 is structured generally to engage shaft 70 by receiving shaft 70 therein. Cam portion 80 extends outwardly away from shaft portion 78 and presents upwardly extending ridge 86 on a top side thereof. Pinion portion 82 extends generally downwardly from cam portion 80 and presents gear teeth 88 and tail portion 90. In the depicted embodiment, gear teeth 88 include three individual gear teeth and tail portion 90 has a generally arcuate triangular shape. This should not be considered limiting.

Referring particularly to FIGS. 4-7 and 9, tilt latch assembly 24 generally includes sliding bolt 92, biasing spring 94 and bolt housing 96.

Sliding bolt 92 generally includes latch portion 98, elongate body portion 100 and rack portions 102. Latch portion 98 generally presents straight side 104 and angled side 106.

Elongate body portion 100 is sized and shaped to be received within housing 96. Elongate body portion 100 generally presents alignment slots 108, spring engagement member 110 and stop peg 112.

Biasing spring 94 in the depicted embodiment includes compression spring 114. Those skilled in the art can utilize other types of springs for biasing spring 94.

Bolt housing 96 is a generally rectangular box like structure as depicted and includes bolt enclosure 116. Bolt enclosure 116 presents flange 118, spring support 120 and slot 122. Bolt enclosure 116 is generally sized and shaped to receive elongate body portion 100 therein.

Figure 10:
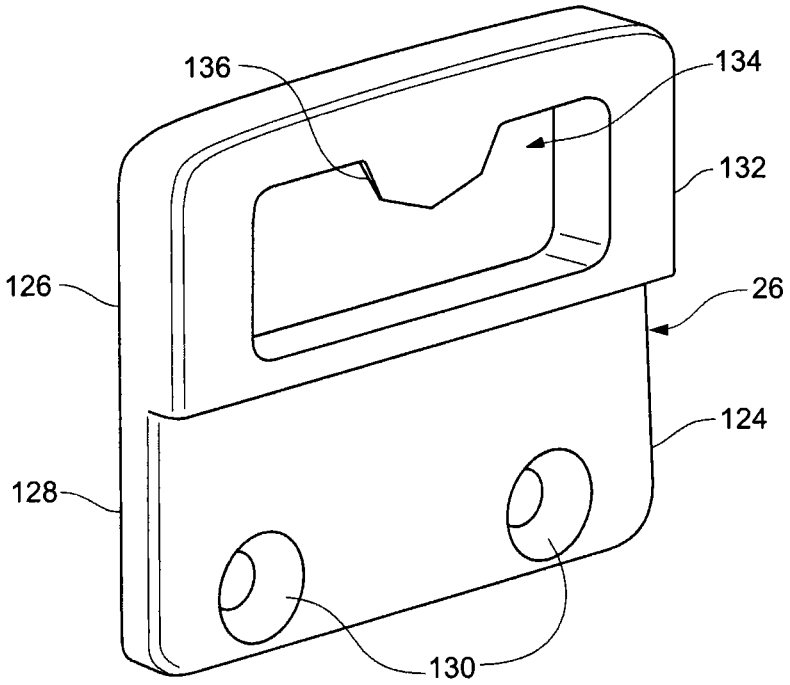
FIG. 10 is an isometric view of a keeper that is part of the integrated lock and latch device of FIG. 1.

Referring particularly to FIG. 10, keeper 26 generally includes mounting portion 124 and cam receiving portion 126. Mounting portion 124 and cam receiving portion 126 are generally part of a unitary structure. Mounting portion 124 generally includes plate 128 presenting fastener holes 130 therethrough.

Cam receiving portion 126 generally includes cam receiving arch 132 surrounding an opening 134 into which extends cam engaging boss 136. Keeper 26 in the depicted embodiment is generally conventional in structure. Keeper 26 may be formed of metal, plastic, composite materials or other materials known to those skilled in the art.

Figure 4:
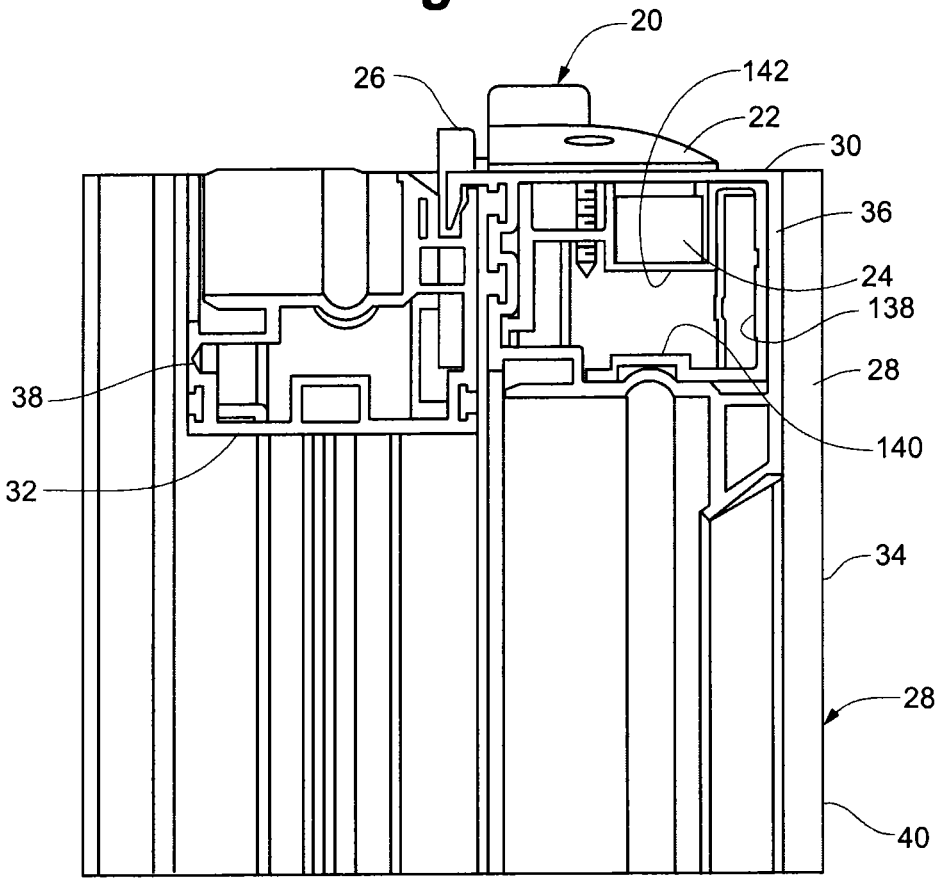
FIG. 4 is a cross sectional view of the integrated lock and latch device depicted in FIG. 1.

Referring particularly to FIG. 4, when inner sash 30 has a hollow sash structure, such as when inner sash 30 is formed from aluminum or vinyl extrusions, interior insert 138 shaped to accept tilt latch assembly 24 aids in alignment and provides structural support for lock assembly 22 and tilt latch assembly 24 within inner sash 30. Interior insert 138 may be an extrusion including sash member conforming portion 140 and tilt latch conforming portion 142. Sash member conforming portion 140 is shaped generally to conform to an interior shape inner sash 130 it is received. Tilt latch conforming portion 142 generally conforms to the exterior shape of tilt latch assembly 24 and is placed to support tilt latch assembly 24 adjacent to and in desired alignment with lock assembly 22.

In operation, lock assembly 22 and tilt latch assembly 24 are secured to lock rail 36 of inner sash 30. Lock assembly 22 may be fitted into a routed space in inner sash 30 on lock rail 36 in a wooden sash. Tilt latch assembly 24 may be inserted into a passage provided in lock rail 36. Keeper 26 is secured, typically by fasteners, to lock rail 38 of outer sash 32.

When lock assembly 22 is assembled and engaged to tilt latch assembly 24, alignment pegs 62 of lock assembly 22 are engaged to alignment slots 108 of sliding bolt 92. Sliding bolt 92 is thus slidably aligned with lock assembly 22 assuring proper positioning of lock assembly 22 relative to tilt latch assembly 24 and engagement of gear teeth 88 to rack portion 102.

Figure 5:
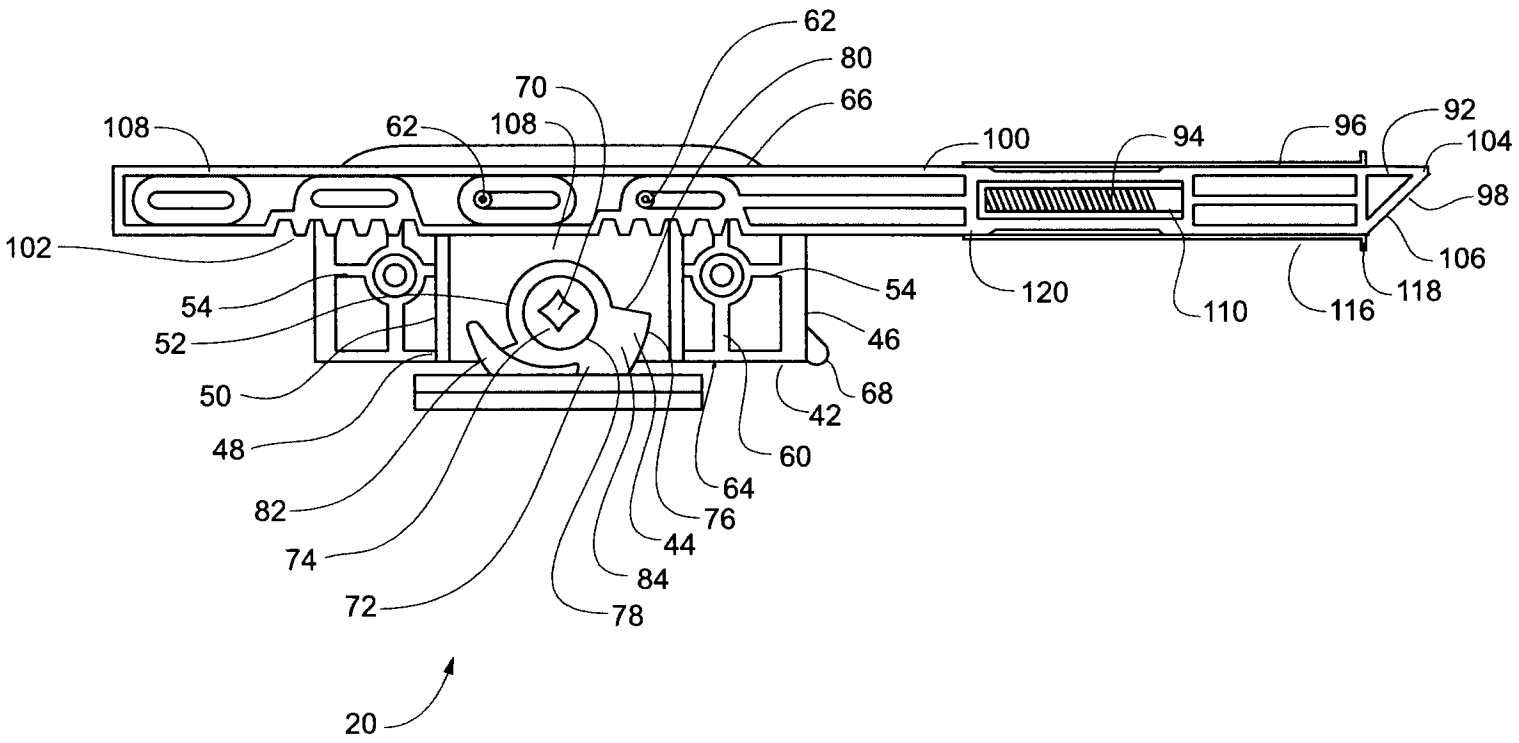
FIG. 5 is a bottom plan view of the integrated lock and latch device of FIG. 1 in a locked position.

Referring particularly to FIGS. 1 and 5, when lock assembly 22 is in the locked position, handle 68 is generally parallel to lock rail 36 and lock rail 38. Sweep cam 72 is engaged to keeper 26 so that sweep cam 72 is received into opening 134 surrounded by cam receiving arch 132. Cam engaging boss 136 engages upwardly extending ridge 86 of cam plate 84 thus impeding the jimmying of lock assembly 22 from keeper 26. As can be seen particularly in FIG. 5, in the locked position, gear teeth 88 of pinion portion 82 are entirely disengaged from rack portion 102 of sliding bolt 92. Thus, sliding bolt 92 is biased by biasing spring 94 outwardly from inner sash 30 so that latch portion 98 protrudes beyond bolt housing 96. Thus, latch portion 98 is engaged to side jamb 40 preventing inner sash 30 from being tilted inward.

Figure 2:
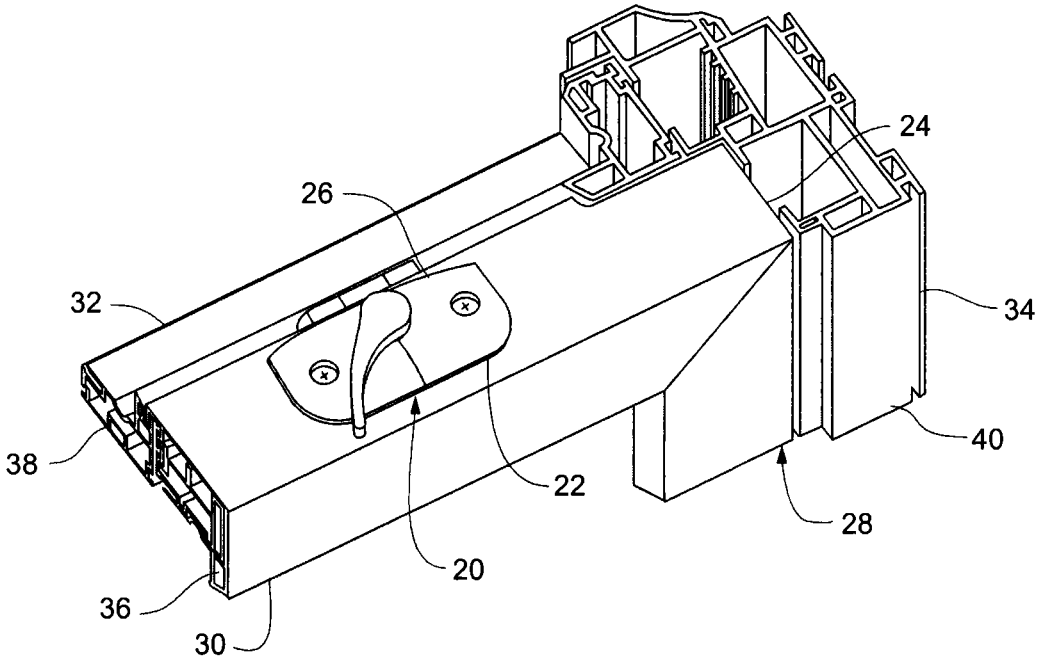
FIG. 2 is a isometric view of the integrated lock and latch device depicted in FIG. 1 in the unlocked orientation.
Figure 6:
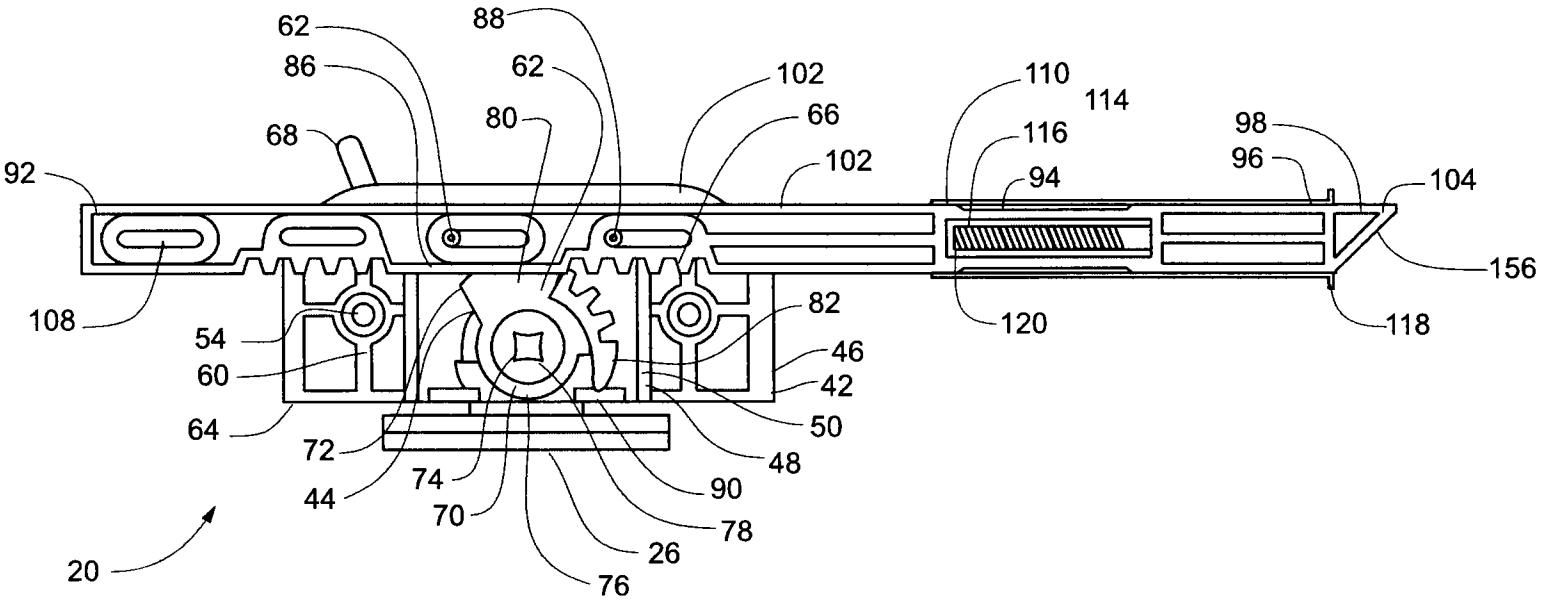
FIG. 6 is a bottom plan view of the integrated lock and latch device of FIG. 1 in an unlocked position.

Referring particularly to FIGS. 2 and 6, when lock assembly 22 is in the unlocked position, handle 68 is oriented generally oblique to lock rail 36 and lock rail 38. Sweep cam 72 is disengaged from keeper 26, thereby allowing relative movement of inner sash 30 and outer sashes 32.

Referring particularly to FIG. 6, in the unlocked position, gear teeth 88 of pinion portion 82 are disengaged from rack portion 102 of sliding bolt 92, but are located near to and with a single gear tooth 88 nearly engaged to rack portion 102. Biasing spring 94 maintains sliding bolt 92 in a position relative to bolt housing 96 so that latch portion 98 extends outwardly from bolt housing 96. Thus, in this orientation, latch portion 98 is still engaged to side jamb 40 preventing inner sash 30 from being tilted inward.

Figure 3:
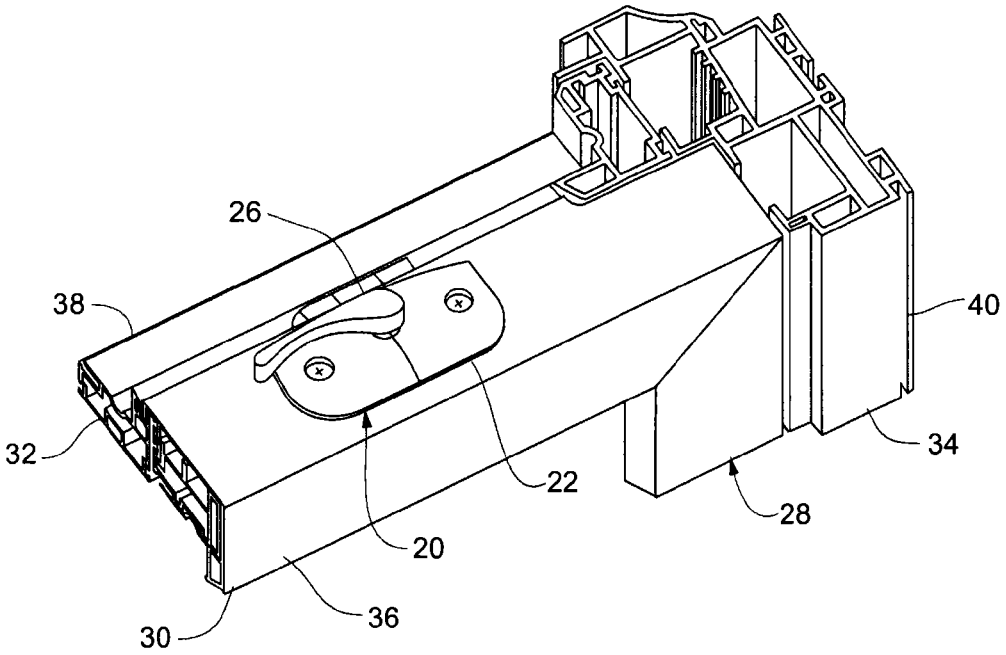
FIG. 3 is an isometric view of the integrated lock and latch device depicted in FIG. 1 in the tilt position.
Figure 7:
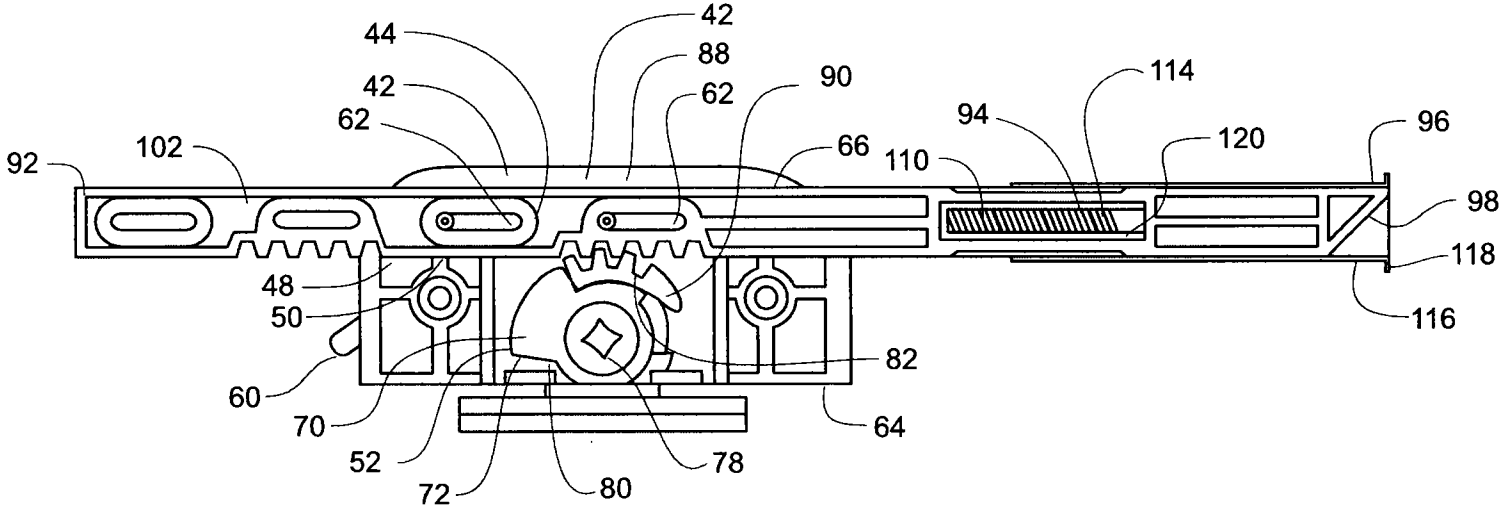
FIG. 7 is a bottom plan view of the integrated lock and latch device of FIG. 1 in a tilt position.

Referring particularly to FIGS. 3 and 7, in the tilt position, handle 68 is again generally parallel to lock rail 36 and lock rail 38 but is oriented approximately 180° differently from the lock position depicted in FIGS. 1 and 5. Sweep cam 72 is still completely disengaged from keeper 26.

As can be seen particularly in FIG. 7, in the tilt position, gear teeth 88 of pinion portion 82 are engaged to rack portion 102 of sliding bolt 92 and have caused sliding bolt 92 to be withdrawn within bolt housing 96. Tail portion 90 abuts rack portion 102 preventing further rotation of pinion portion 82 and further retraction of sliding bolt 92. Thus, latch portion 98 of sliding bolt 92 is withdrawn into bolt housing 96 while biasing spring 94 is compressed, thus withdrawing latch portion 98 from engagement to side jamb 40. This frees inner sash 30 to be tilted inwardly out of parallel alignment with side jamb 40. This permits access to the exterior of inner sash 30 for cleaning or other activities.

When handle 68 is released, biasing spring 94 again extends latch portion 98 of sliding bolt 92 beyond inner sash 30 so that latch portion 98 protrudes beyond bolt housing 96. At the same time, handle 68 returns to the unlocked position as depicted in FIG. 2 by the combined bias force of biasing spring 94 and detent spring 56.

Integrated lock and latch device 20 of the present invention provides a number of benefits and advantages. Assembly of lock assembly 22 to tilt latch assembly 24, via engagement of alignment slots 108 and alignment pegs 62, provides easy direct alignment of the two assemblies relative to each other.

Sliding bolt 92 is pre-tensioned relative to bolt housing 96. This helps provides positive placement of tilt latch assembly 24 relative to lock assembly 22. Alignment slots 108 are tapered on sliding bolt 92 to help provide positive and easy self alignment with alignment pegs 62 on lock assembly 22. Alignment pegs 62 are also tapered.

Because of the presence of multiple rack portions 102 on sliding bolt 92, a single tilt latch assembly 24 is able to handle a variety of lock assembly 22, set-back positions on inner sash 30.

Direct interface of pinion portion 82 with rack portion 102 eliminates the need for intermediate elements connecting lock assembly 22 to tilt latch assembly 24. This makes assembly of integrated lock and latch device 20 of the present invention quicker and easier.

The direct interface of pinion portion 82 of sweep cam 72 with rack portion 102 minimizes play and tolerance build-up between lock assembly 22 and tilt latch assembly 24. Bolt housing 96 of tilt latch assembly 24 does not require additional retention features to prevent it from coming out inner sash 30. Assembly of lock assembly 22 to tilt latch assembly 24 and the action of biasing spring 94 prevents bolt housing 96 from unintentionally coming out of inner sash 30. This aspect of integrated lock and latch device 20 also makes assembly quicker and easier.

In the event that inner sash 30 has a hollow structure, interior insert 138 is inserted into inner sash 30 prior to the insertion of tilt latch assembly 24 and lock assembly 22. Alternately, tilt latch assembly 24 may be inserted into interior insert 138 and then the assembled interior insert 138 and tilt latch assembly 24 may be inserted into inner sash 30 together. Tilt latch conforming portion 142 at least partially surrounds and supports tilt latch assembly 24 in relation to lock assembly 22. Sash member conforming portion 140 abuts interior surfaces of inner sash 30 and thus provides solid support to tilt latch assembly 24.

As depicted in FIGS. 10-33, integrated lock and latch device 220 according to a second embodiment of the present invention generally includes lock assembly 222, tilt latch assembly 224 and keeper 226. Integrated lock and latch device 220 is adapted to be used in a double-hung window 228, generally including inner sash 230, outer sash 232 and frame 234. Integrated lock and latch device 220 is adapted to be used in other sliding sash windows as well. Inner sash 230 and outer sash 232 are slidably engaged with frame 234. In this exemplary embodiment, inner sash 230 includes lock rail 236 at a top thereof and outer sash 232 includes lock rail 238 at a lower edge thereof. Frame 234 also presents side jamb 240.

Referring particularly to FIGS. 19-28, lock assembly 222 generally includes housing 242 and sweep cam assembly 244.

Figure 25:
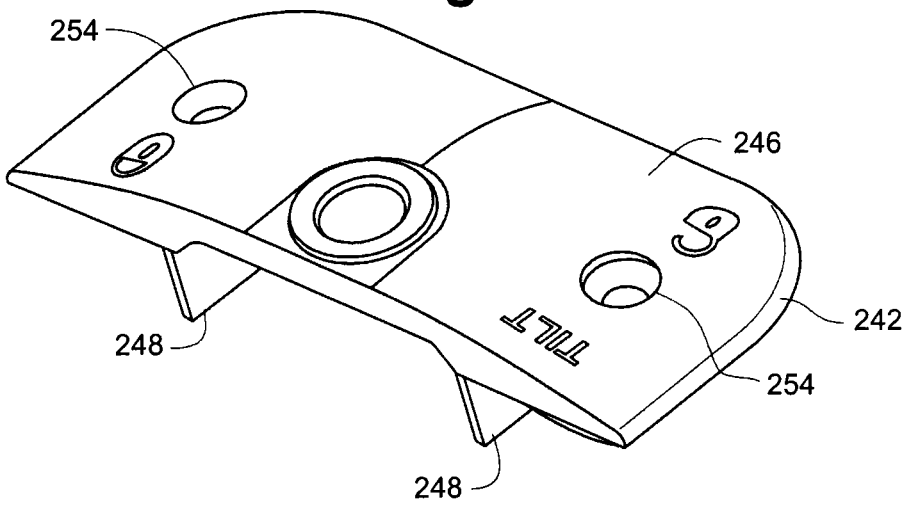
FIG. 25 is a top isometric view of the housing of the lock assembly of FIG. 15.
Figure 26:
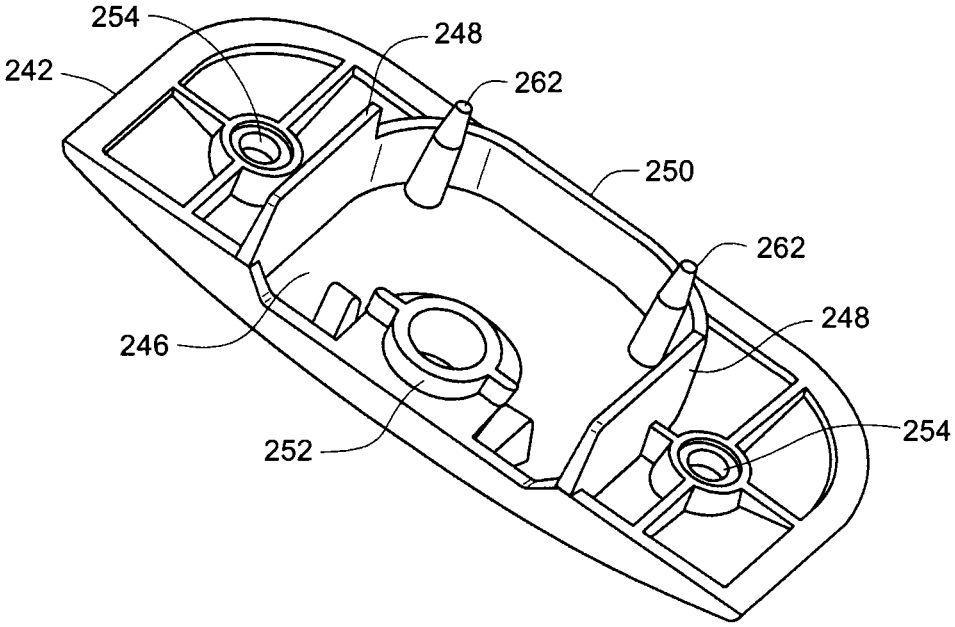
FIG. 26 is a bottom isometric view of the housing of the lock assembly of FIG. 15.
Figure 27:
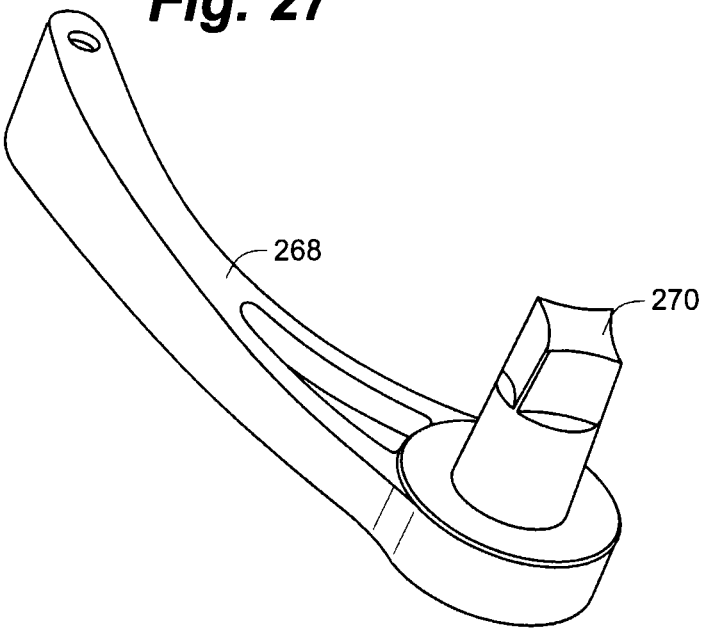
FIG. 27 is a bottom isometric view of the handle of the lock assembly of FIG. 15.
Figure 28:
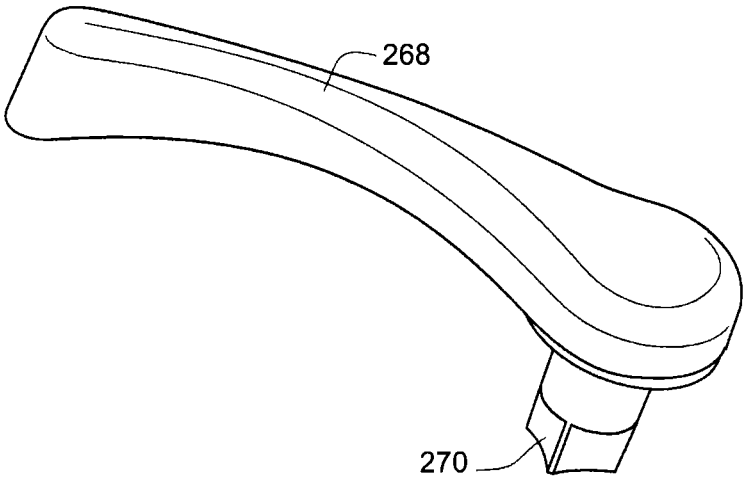
FIG. 28 is a top isometric view of the handle of the lock assembly of FIG. 15.
Figure 29:
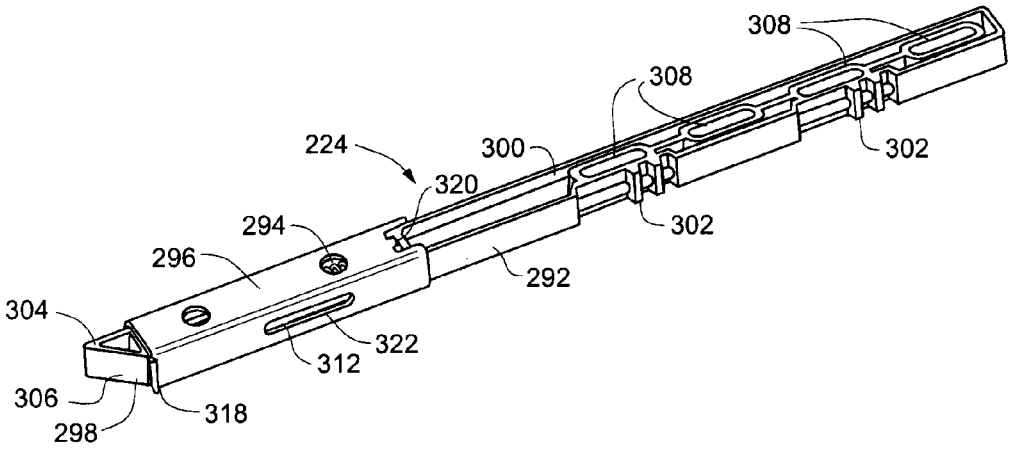
FIG. 29 is an isometric view of the latch assembly of the device of FIG. 11.
Figure 30:
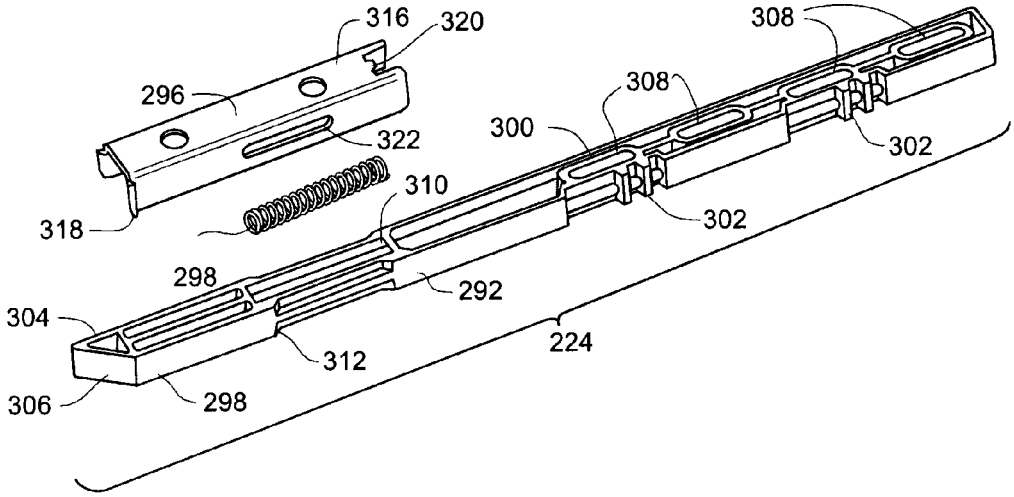
FIG. 30 is an exploded view of the latch assembly of the device of FIG. 11.
Figure 31:
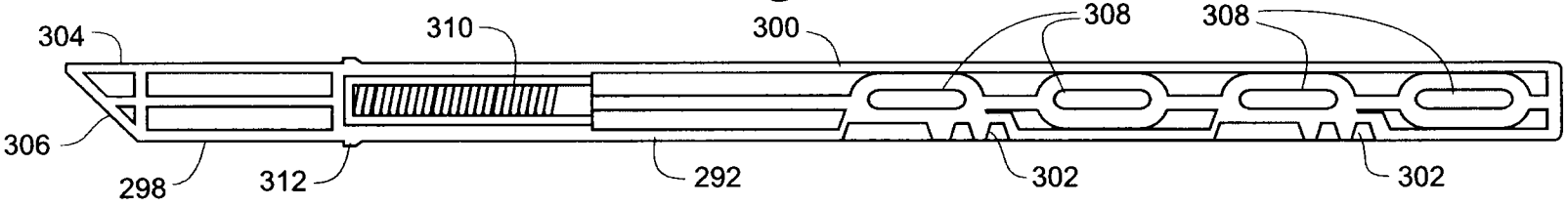
FIG. 31 is a plan view of the bolt of the latch assembly of FIG. 29.
Figure 32:
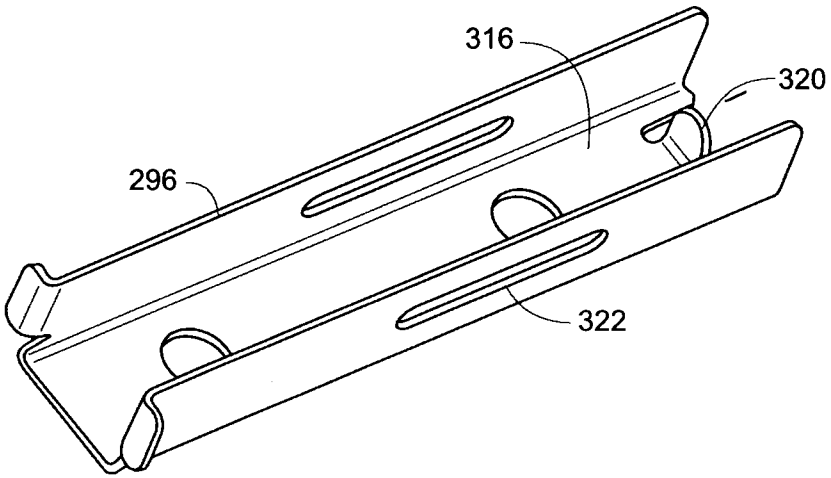
FIG. 32 is an isometric view of the bolt housing of the latch assembly of FIG. 29.
Figure 33:
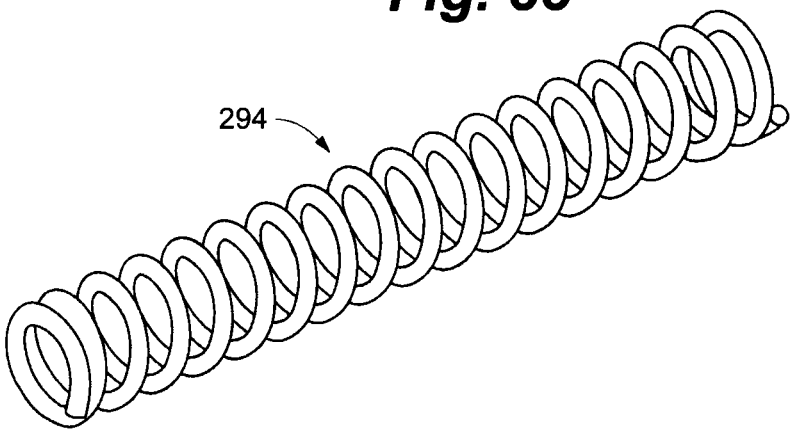
FIG. 33 is an isometric view of the spring of the latch assembly of FIG. 29.
Figure 34:
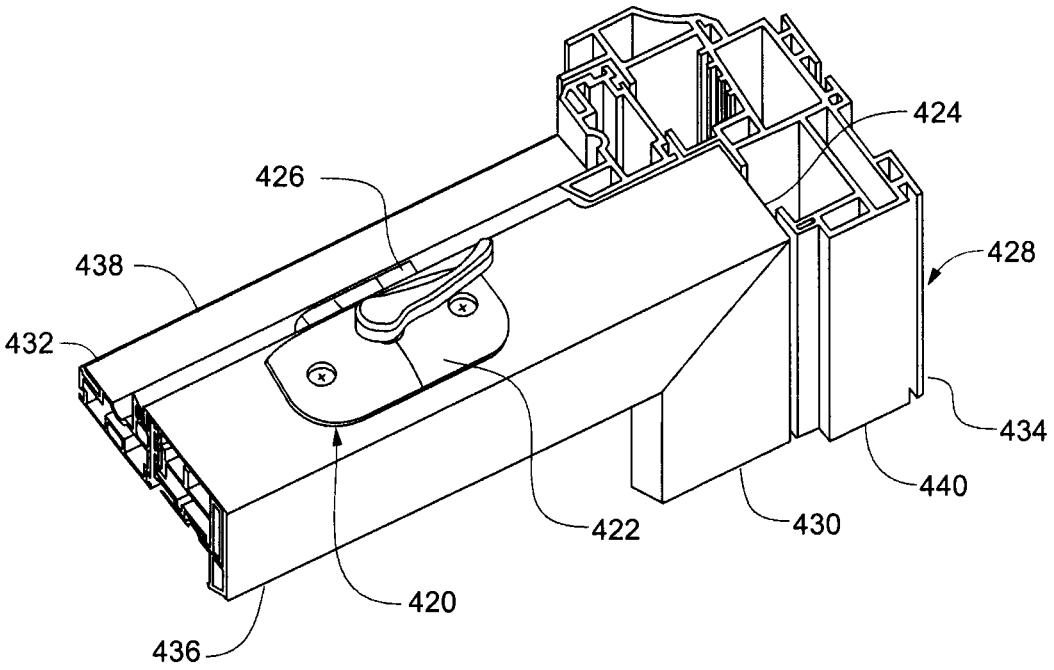
FIG. 34 is an isometric view of an integrated lock and latch device mounted in a window sash in the locked orientation according to an embodiment.
Figure 35:
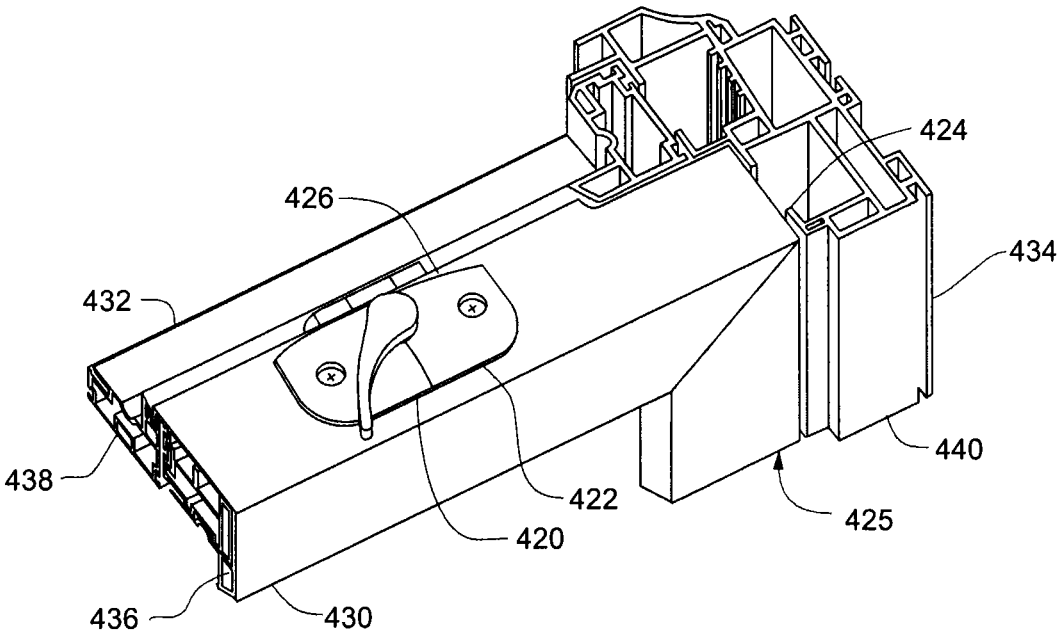
FIG. 35 is an isometric view of the integrated lock and latch device depicted in FIG. 34 in the unlocked orientation.
Figure 36:
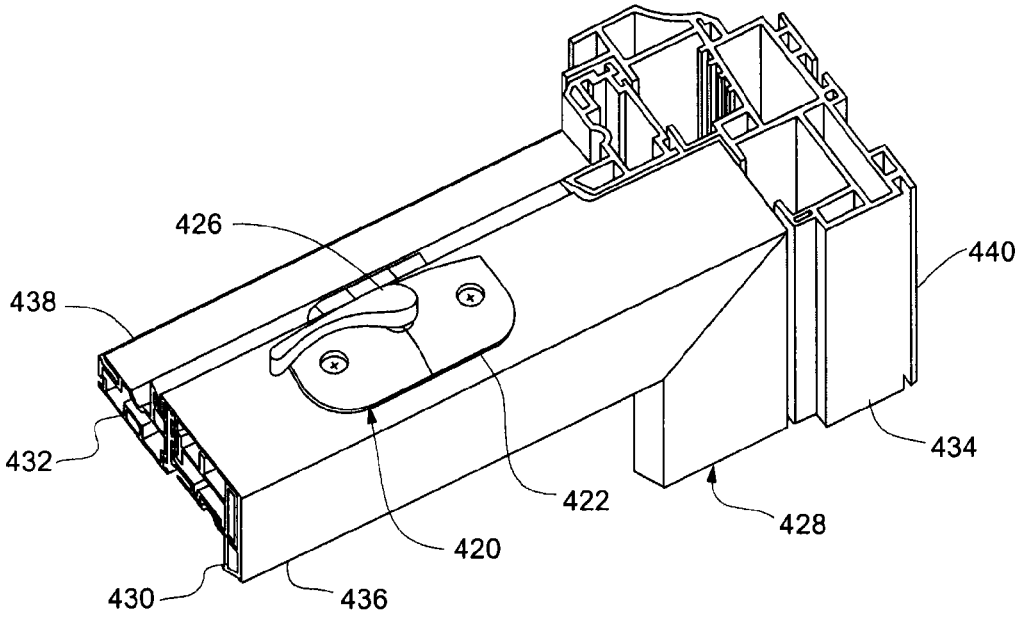
FIG. 36 is an isometric view of the integrated lock and latch device depicted in FIG. 34 in the tilt position.
Figure 37:
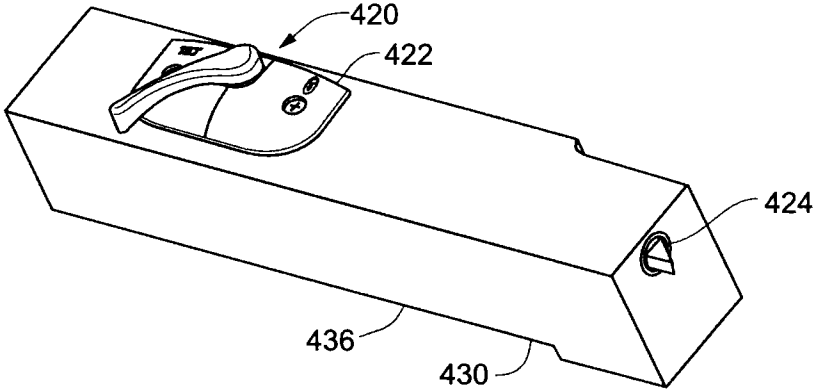
FIG. 37 is an isometric view of the integrated lock and latch device depicting a sliding bolt extending from a sash stile.
Figure 38:
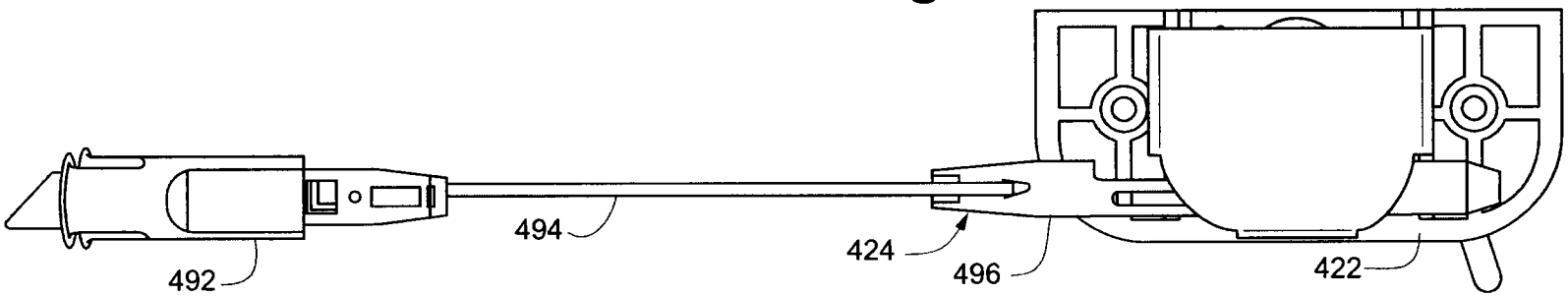
FIG. 38 is a bottom plan view of the integrated lock and latch device of FIG. 37 in an unlocked position.
Figure 39:
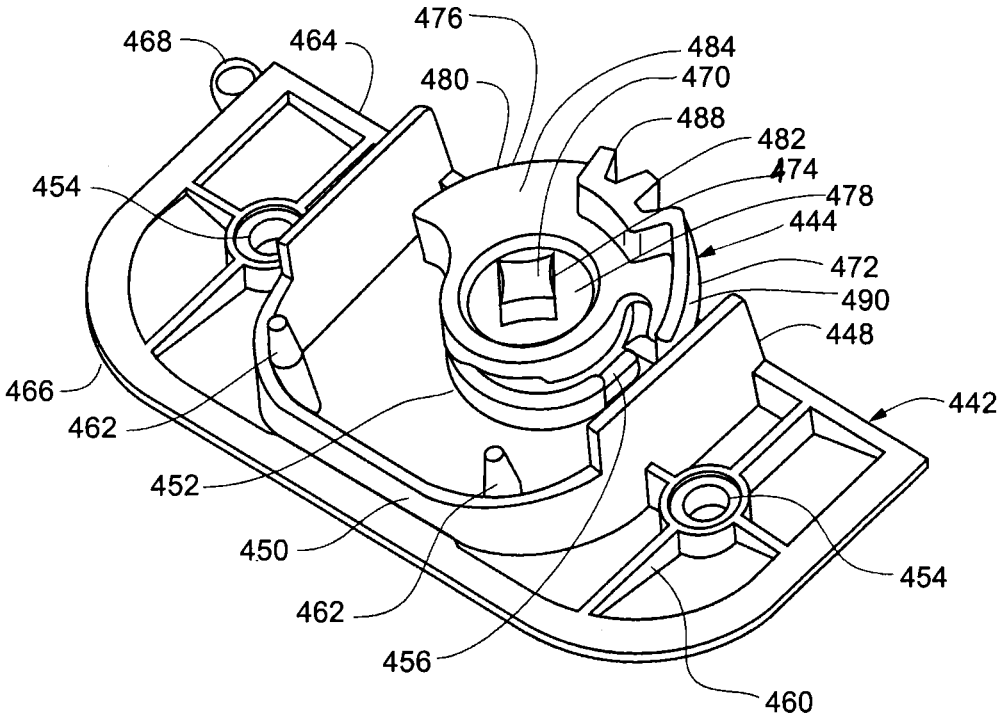
FIG. 39 is a bottom isometric view of the lock assembly of FIG. 34.
Figure 40:
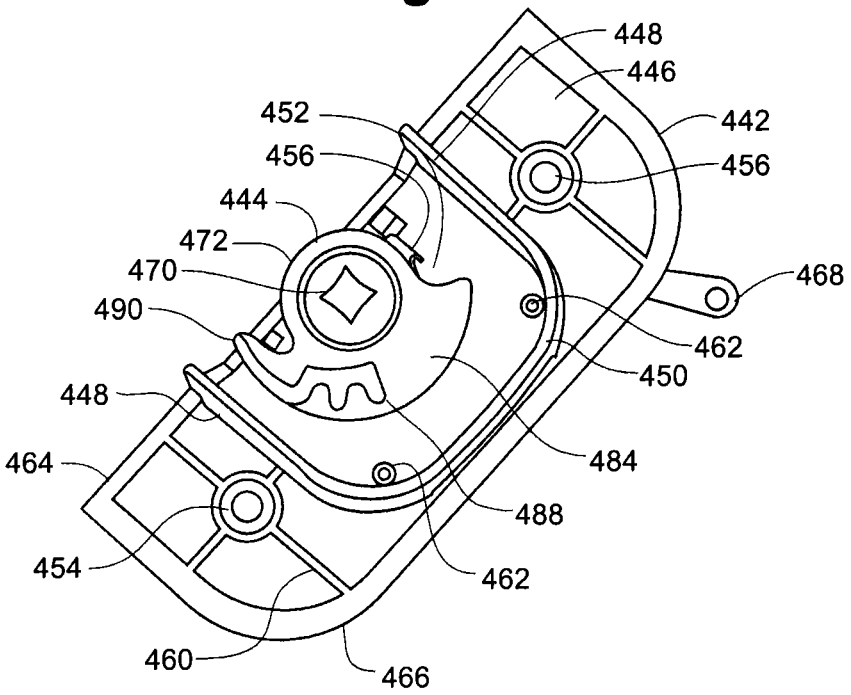
FIG. 40 is another bottom isometric view of the latch assembly of FIG. 34.
Figure 41:
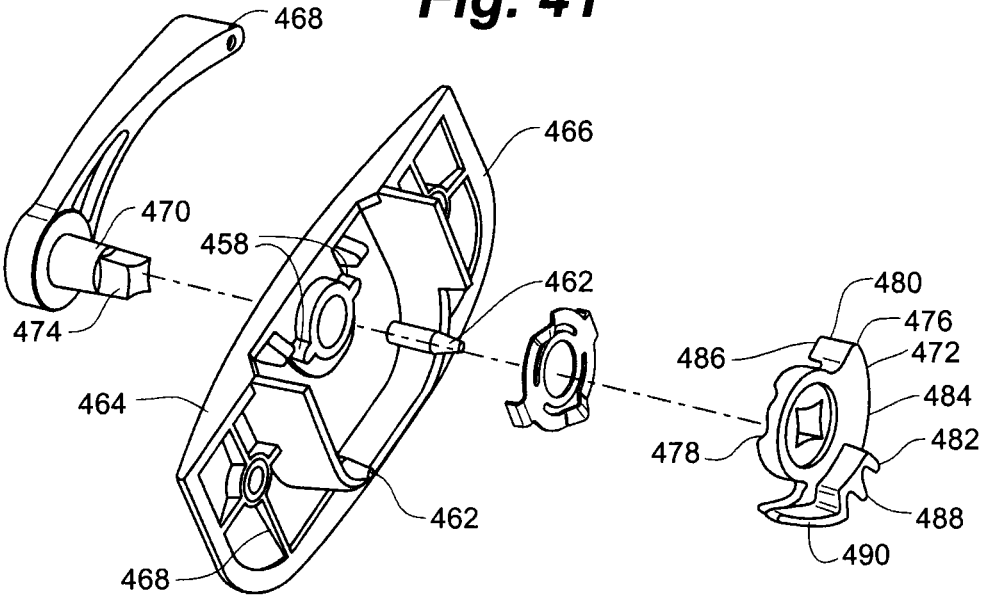
FIG. 41 is an exploded isometric view of the lock assembly of FIG. 34.
Figure 42:
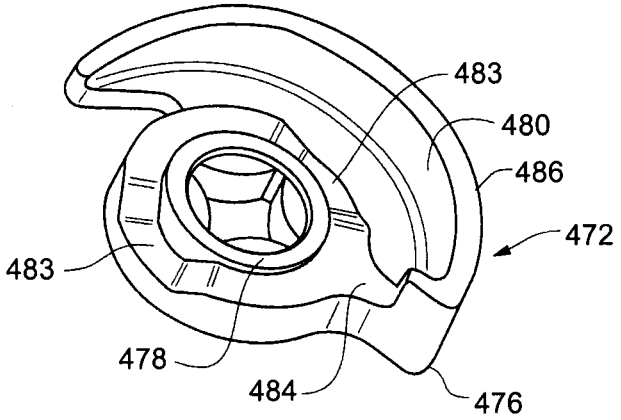
FIG. 42 is a top isometric view of a sweep cam of the embodiment of FIG. 34.
Figure 43:
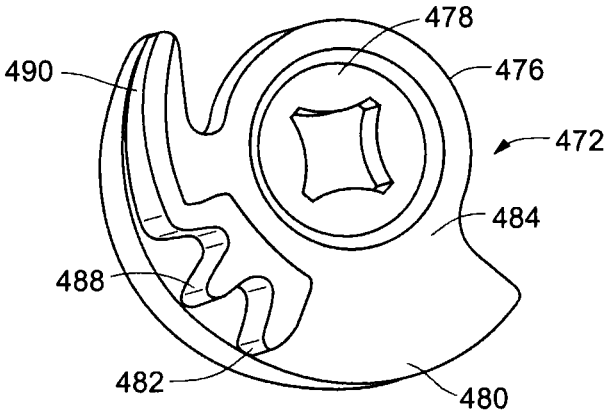
FIG. 43 is a bottom isometric view of the sweep cam of the embodiment of FIG. 34.
Figure 44:
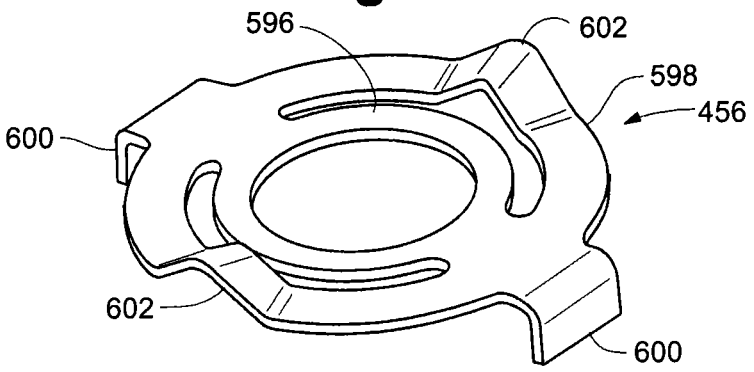
FIG. 44 is a top isometric view of a detent spring of the embodiment of FIG. 34.
Figure 45:
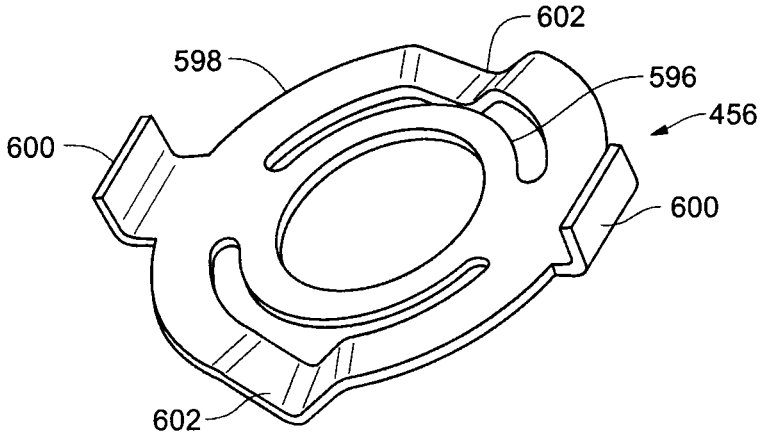
FIG. 45 is bottom isometric view of the detent spring of FIG. 44 according to an exemplary embodiment.
Figure 46:
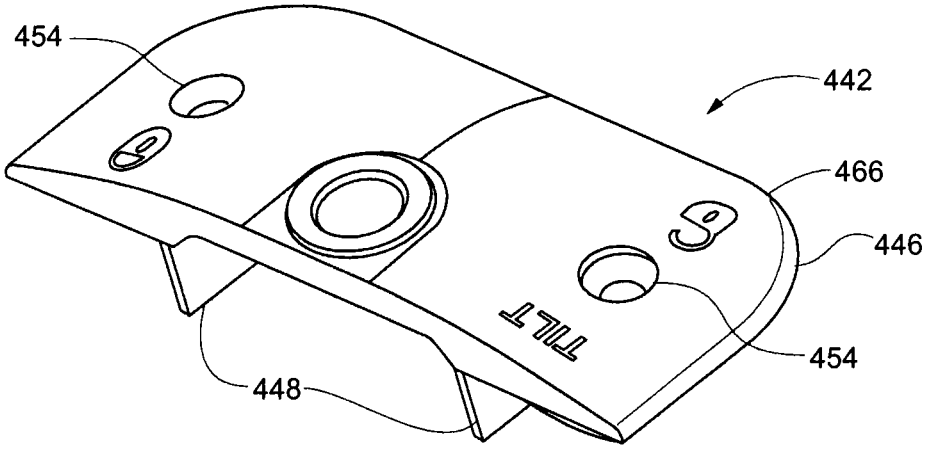
FIG. 46 is a top isometric view of a lock housing of the embodiment of FIG. 34.
Figure 47:
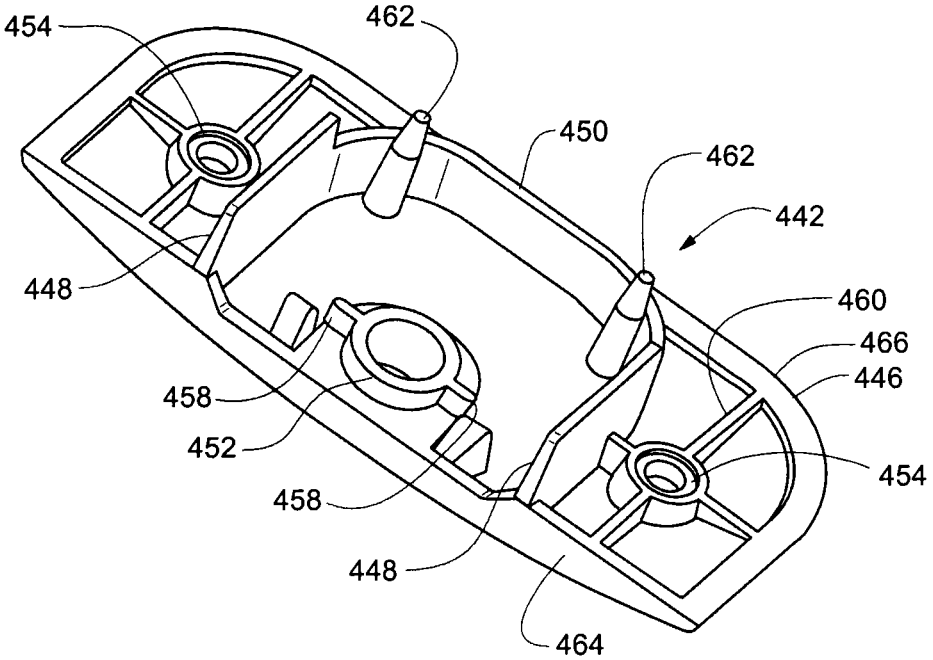
FIG. 47 is a bottom isometric view of the lock housing of FIG. 46.
Figure 48:
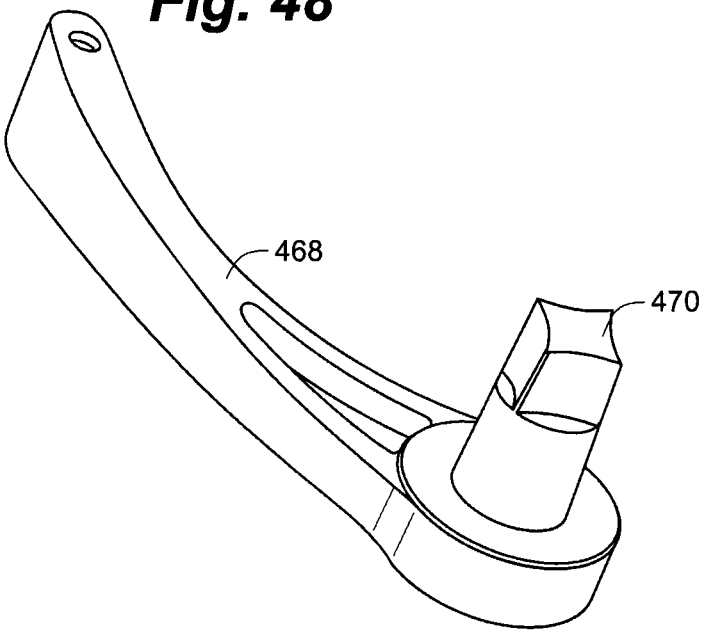
FIG. 48 is a bottom isometric view of a handle according to the embodiment of FIG. 34.
Figure 49:
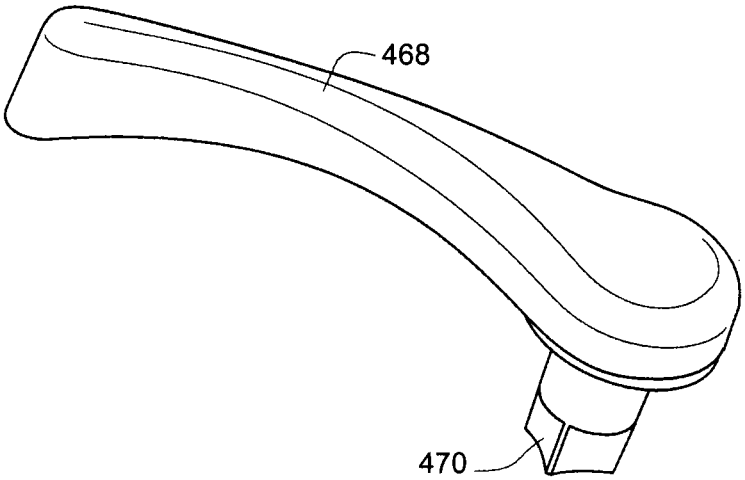
FIG. 49 is a top isometric view of the handle of FIG. 48.
Figure 50:
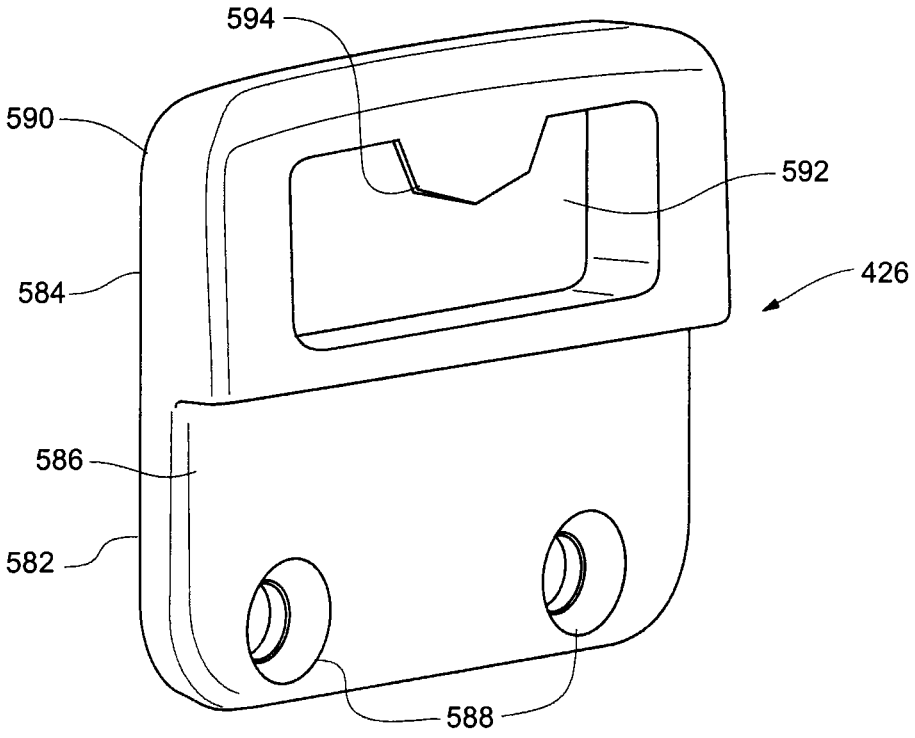
FIG. 50 is an isometric view of a keeper according to the embodiment of FIG. 34.
Figure 51:
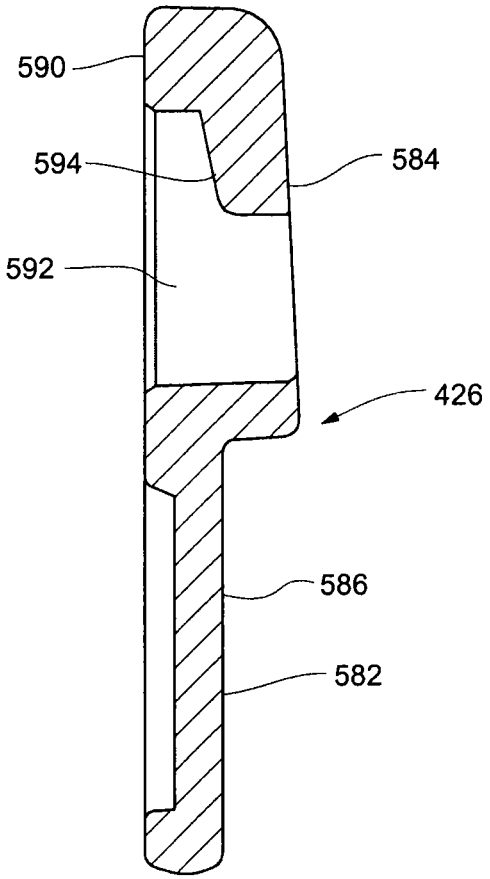
FIG. 51 is a cross sectional view of the keeper of FIG. 49.
Figure 52:
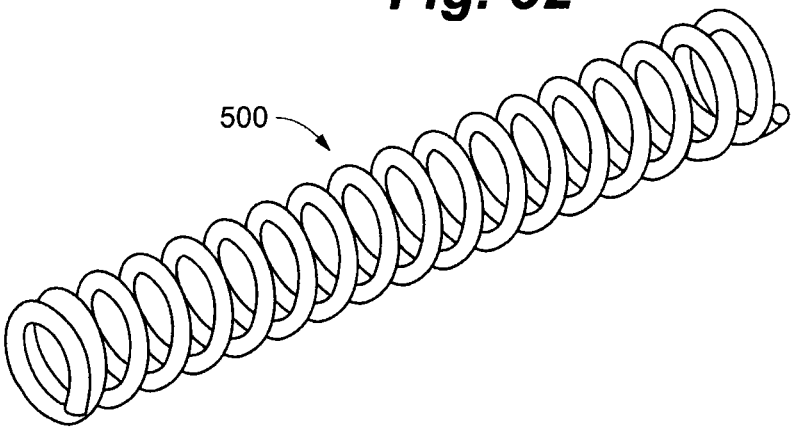
FIG. 52 is an isometric view of biasing spring according to the embodiment of FIG. 34.
Figure 53:
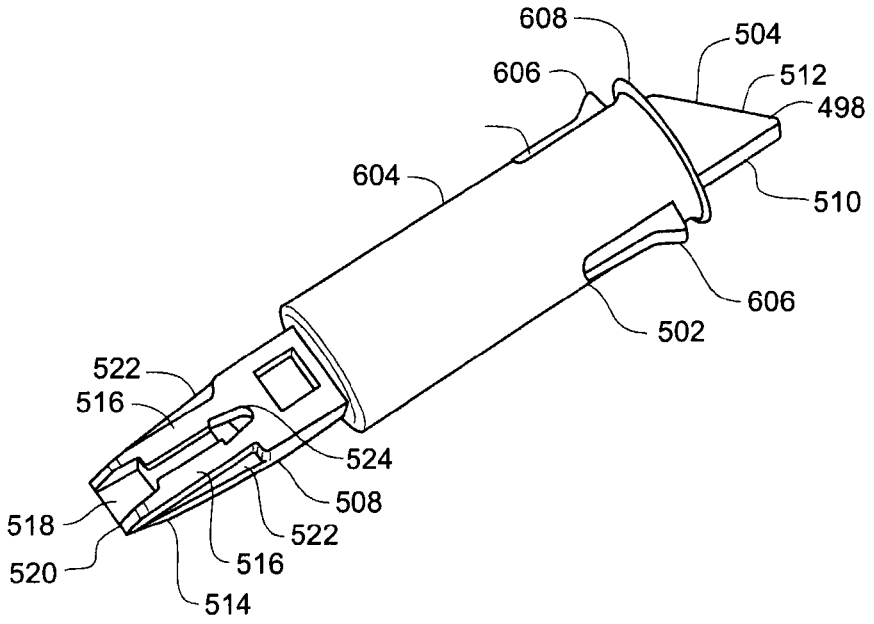
FIG. 53 is an isometric view of a latch assembly according to the embodiment of FIG. 34.
Figure 54:
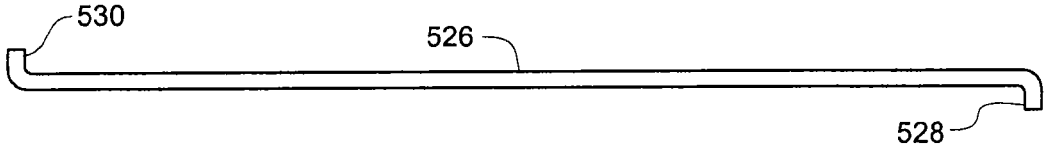
FIG. 54 is a plan view of linking member according to the embodiment of FIG. 34.
Figure 55:
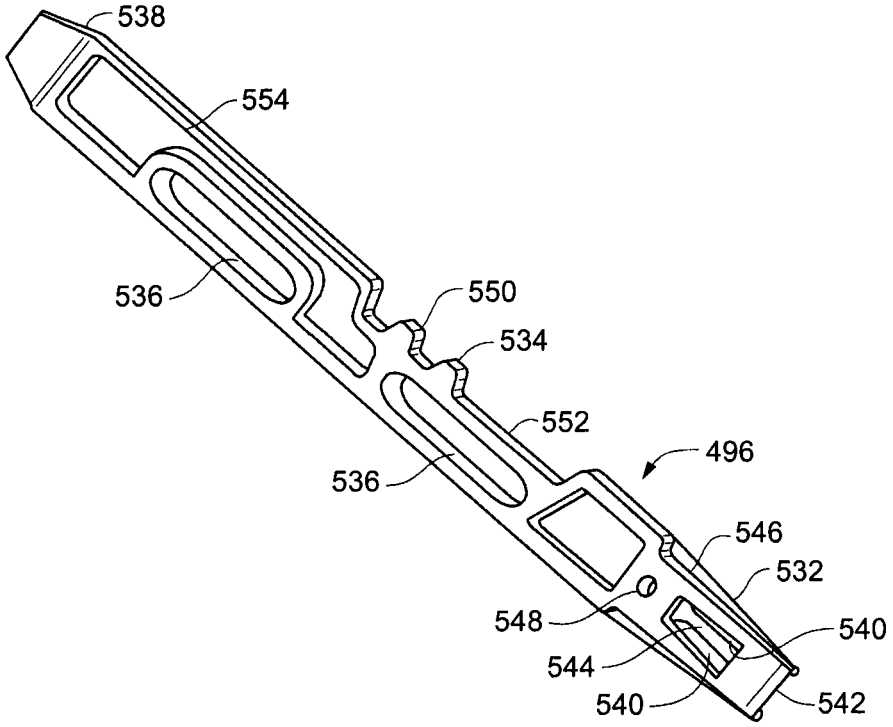
FIG. 55 is an isometric view of a drive member according to the embodiment of FIG. 34.
Figure 56:
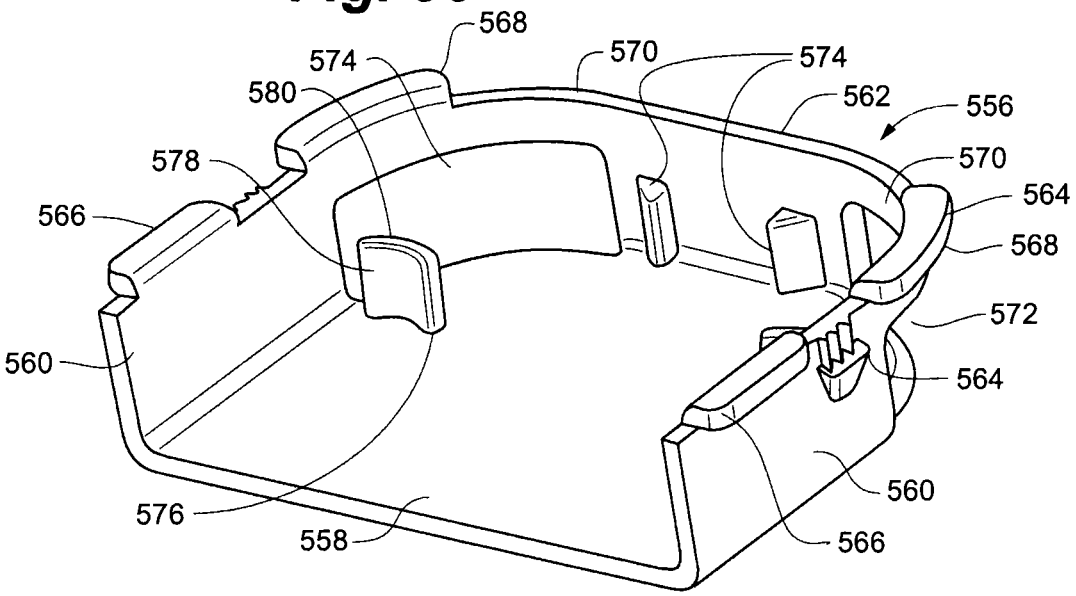
FIG. 56 is an isometric view of a cage according to the embodiment of FIG. 34.

Referring particularly to FIGS. 25 and 26, housing 242 is a generally unitary structure including mounting plate 246, bosses 248, wall 250 and sweep cam support 252. As can be seen, bosses 248 and wall 250 extend downwardly from mounting plate 246. Sweep cam support 252 has a generally annular structure and also extends downwardly from mounting plate 246. Mounting plate 246 presents fastener holes 254 for receiving fasteners such as screws (not shown).

Figure 20:
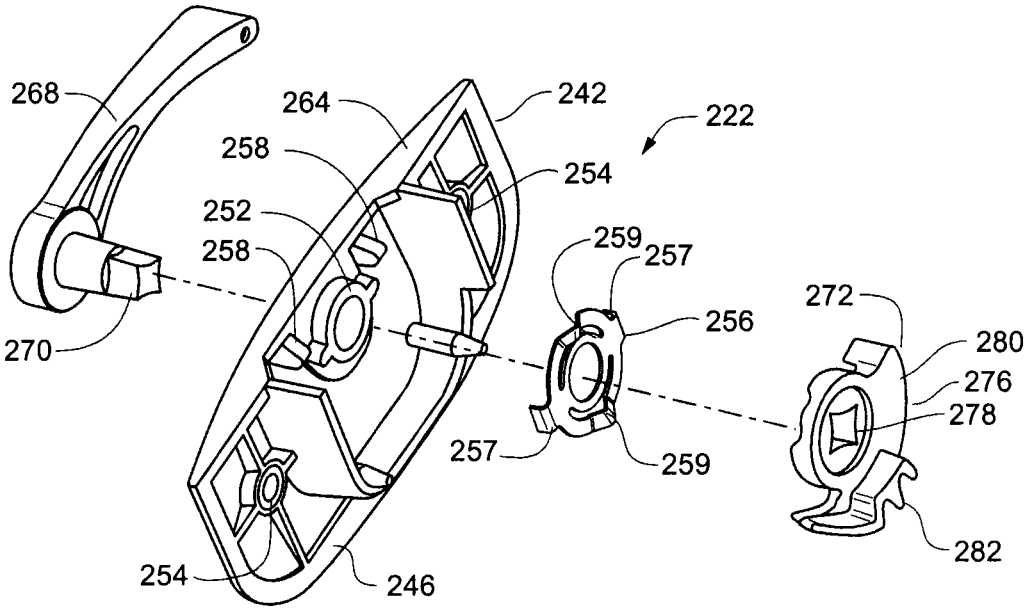
FIG. 20 is an exploded view of the lock assembly of FIG. 15.

Detent spring 256 engages over sweep cam support 252 as depicted in FIG. 20. Sweep cam support 252 presents detent spring stops 258, which engage tabs 257 of detent spring 256. Raised portions 259 interact with sloped recesses 261 of sweep cam 272. Mounting plate 246 may be formed as a casting or molding and may present reinforcing ridges 260 on a bottom side thereof. Wall 250 may present alignment pegs 262. Housing 242 may include flat edge 264 and curved edge 266 forming its perimeter.

Sweep cam assembly 244 generally includes handle 268, shaft 270 and sweep cam 272. Handle 268 is coupled to sweep cam 272 by shaft 270. In the depicted exemplary embodiment, shaft 270 passes through mounting plate 246 and within sweep cam support 252. Shaft 270 has a generally square cross section. Handle 268 is generally conventional in design and may be formed as an integral structure with shaft 270. Shaft 270, viewed in cross section, may present concave faces 274 or have a truly square cross section.

Figure 21:
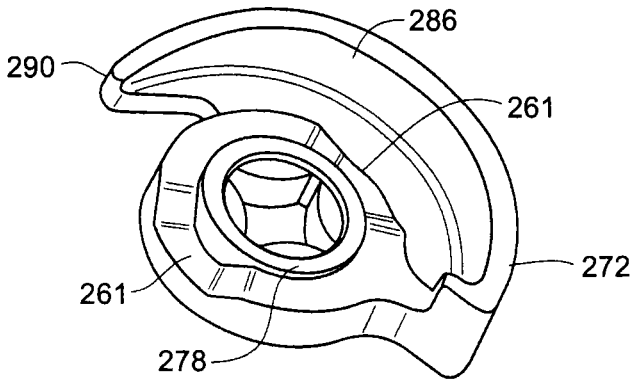
FIG. 21 is a top isometric view of the sweep cam of the lock assembly of FIG. 15.
Figure 22:
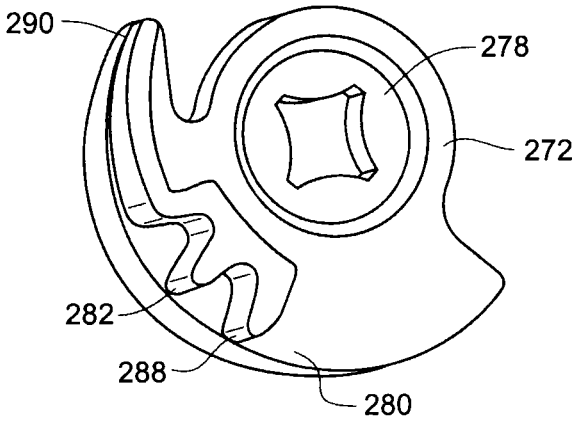
FIG. 22 is a bottom isometric view of the sweep cam of the lock assembly of FIG. 15.
Figure 23:
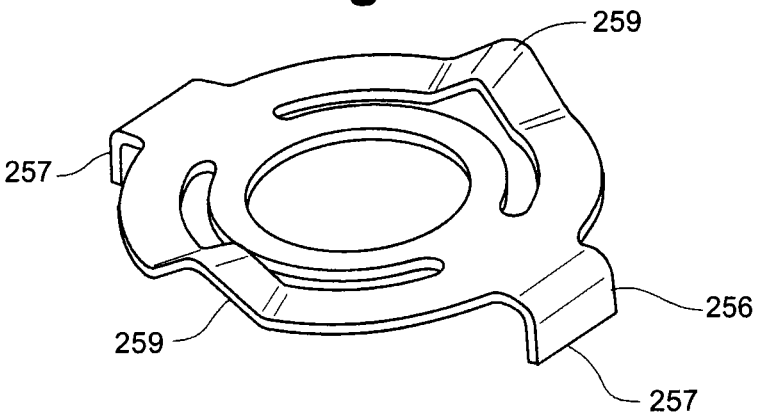
FIG. 23 is a bottom view of the spring of the lock assembly of FIG. 15.
Figure 24:
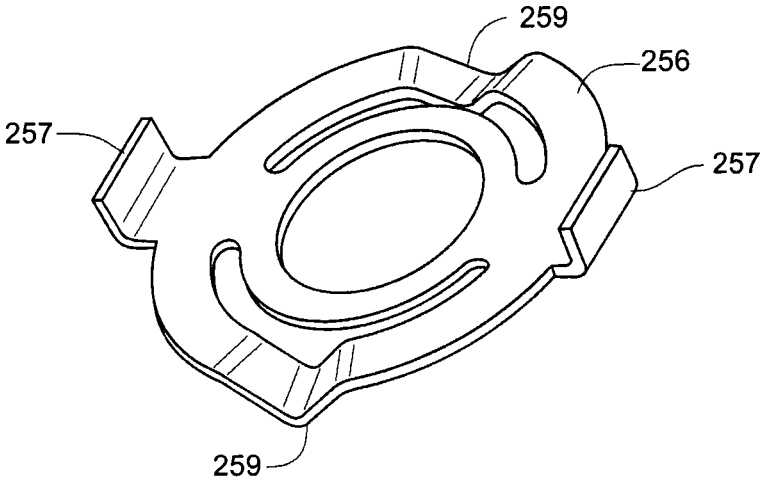
FIG. 24 is a top view of the spring of the lock assembly of FIG. 15.

Referring particularly to FIGS. 21-22, sweep cam 272 generally includes body 276, presenting shaft portion 278, cam portion 280 and pinion portion 282. Shaft portion 278 is structured generally to engage shaft 270 by receiving shaft 270 therein. Cam portion 280 extends outwardly away from shaft portion 278 and presents upwardly extending ridge 286 on a top side thereof. Pinion portion 282 extends generally downwardly from cam portion 280 and presents gear teeth 288 and tail portion 290. In the depicted embodiment, gear teeth 288 include two individual gear teeth and tail portion 290 has a generally arcuate triangular shape. This should not be considered limiting.

Referring particularly to FIGS. 29-33, tilt latch assembly 224 generally includes sliding bolt 292, biasing spring 294 and bolt housing 296. Sliding bolt 292 generally includes latch portion 298, elongate body portion 300 and rack portions 302. Latch portion 298 generally presents straight side 304 and angled side 306. Elongate body portion 300 is sized and shaped to be received within housing 296. Elongate body portion 300 generally presents alignment slots 308, spring engagement member 310 and stop peg 312.

Biasing spring 294 in the depicted embodiment includes compression spring 314. Those skilled in the art can utilize other types of springs for biasing spring 294.

Bolt housing 296 is a generally rectangular box like structure as depicted and includes bolt enclosure 316. Bolt enclosure 316 presents flange 318, spring support 320 and slot 322. Bolt enclosure 316 is generally sized and shaped to receive elongate body portion 300 therein.

Figure 17:
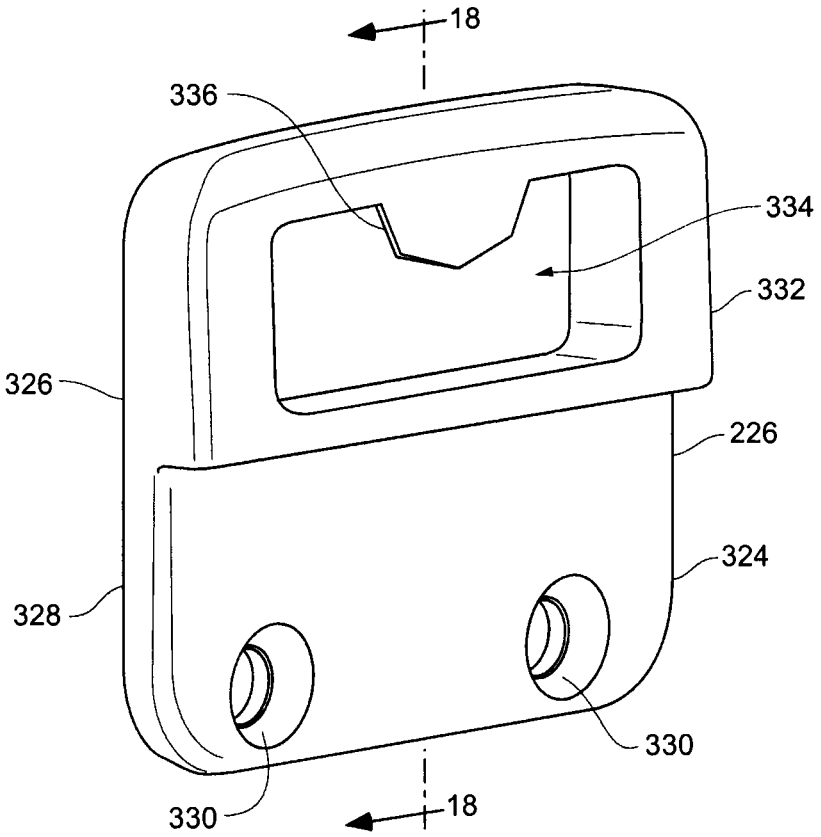
FIG. 17 is an isometric view of a keeper that is part of the integrated lock and latch device of FIG. 11.
Figure 18:
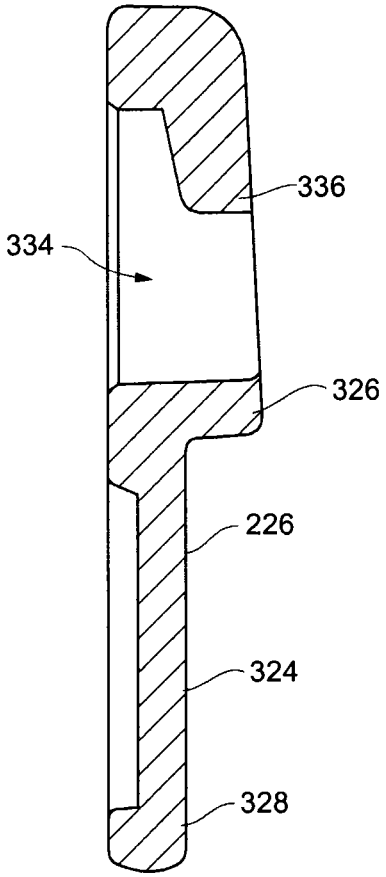
FIG. 18 is a cross-section of the keeper of FIG. 17, taken at section 18-18 of FIG. 17.
Figure 19:
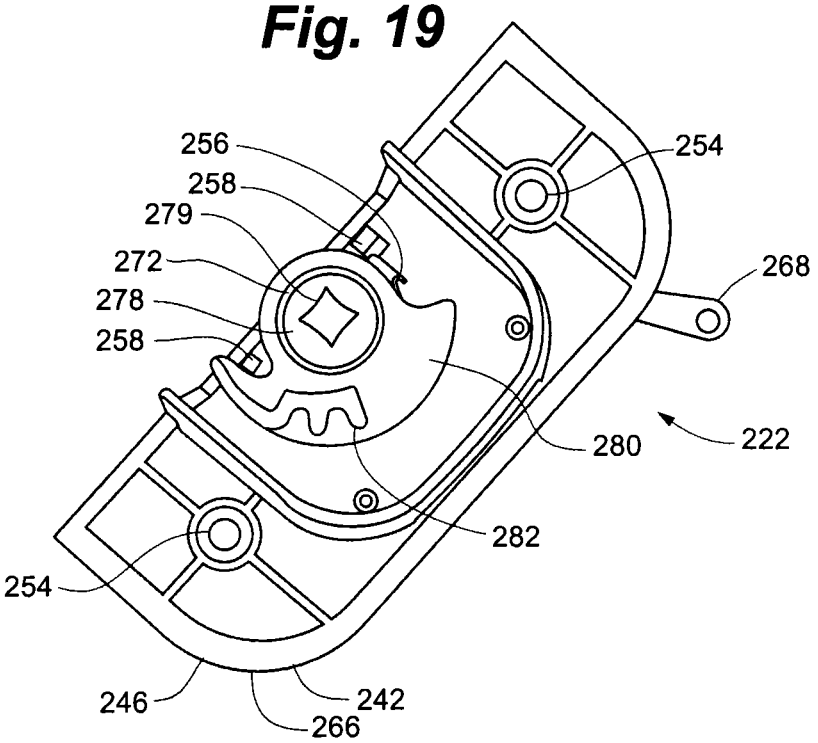
FIG. 19 is a bottom view of the lock assembly of FIG. 15.

Referring particularly to FIGS. 17-18, keeper 226 generally includes mounting portion 324 and cam receiving portion 326. Mounting portion 324 and cam receiving portion 326 are generally part of a unitary structure. Mounting portion 324 generally includes plate 328 presenting fastener holes 330 therethrough. Cam receiving portion 326 generally includes cam receiving arch 332 surrounding an opening 334 into which extends cam engaging boss 336. Keeper 226 in the depicted embodiment is generally conventional in structure. Keeper 226 may be formed of metal, plastic, composite materials or other materials known to those skilled in the art. An advantageous feature of the depicted embodiment is that the lower edge of cam receiving portion 326 extends outwardly toward lock assembly 222 a relatively greater distance than prior art keeper designs. This feature creates a smaller gap between components so as to improve resistance to picking and thus greater forced entry resistance (FER), and also a larger support surface for the bottom of sweep cam 272 to help prevent cam rollout during impact testing.

Figure 11:
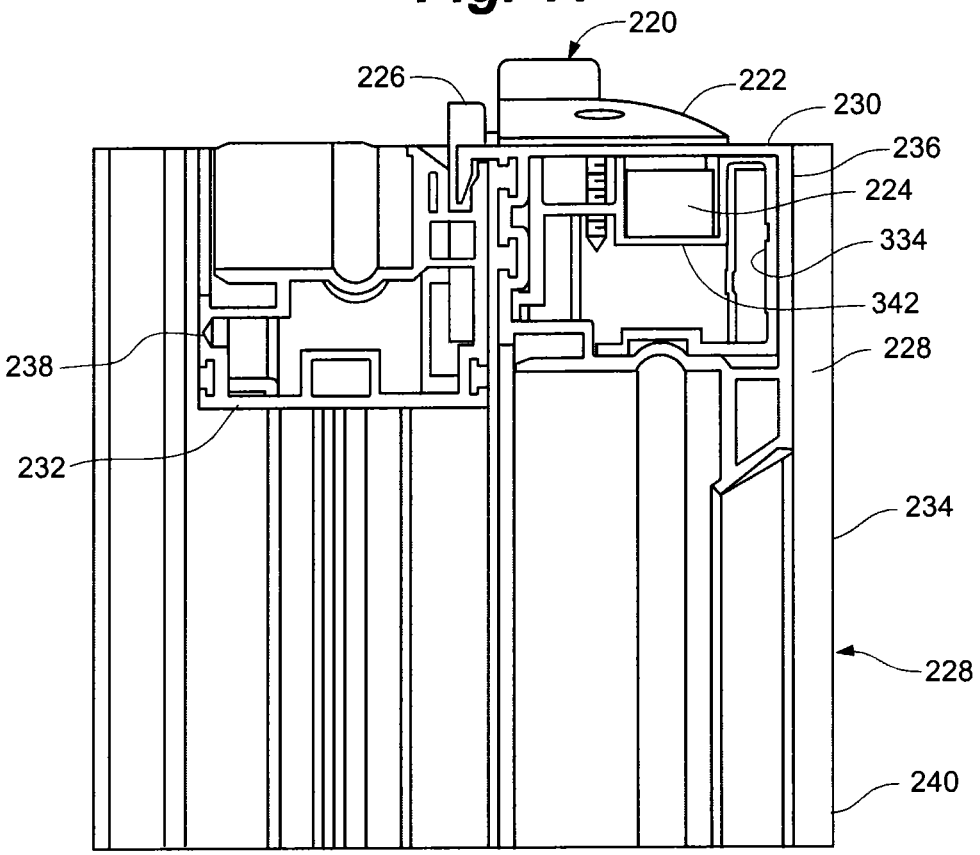
FIG. 11 is a cross-sectional view of an integrated lock and latch device mounted in a window sash according to a second embodiment.

Referring particularly to FIG. 11, when inner sash 230 has a hollow sash structure, such as when inner sash 230 is formed from aluminum or vinyl extrusions, interior insert 338 shaped to accept tilt latch assembly 224 aids in alignment and provides structural support for lock assembly 222 and tilt latch assembly 224 within inner sash 230. Interior insert 338 may be an extrusion including sash member conforming portion 340 and tilt latch conforming portion 342. Sash member conforming portion 340 is shaped generally to conform to an interior shape inner sash 330 it is received. Tilt latch conforming portion 342 generally conforms to the exterior shape of tilt latch assembly 224 and is placed to support tilt latch assembly 224 adjacent to and in desired alignment with lock assembly 222.

In operation, lock assembly 222 and tilt latch assembly 224 are secured to lock rail 236 of inner sash 230. Lock assembly 222 may be fitted into a routed space in inner sash 230 on lock rail 236 in a wooden sash. Tilt latch assembly 224 may be inserted into a passage provided in lock rail 236. Keeper 226 is secured, typically by fasteners, to lock rail 238 of outer sash 232.

When lock assembly 222 is assembled and engaged to tilt latch assembly 224, alignment pegs 262 of lock assembly 222 are engaged to alignment slots 308 of sliding bolt 292. Sliding bolt 292 is thus slidably aligned with lock assembly 222 assuring proper positioning of lock assembly 222 relative to tilt latch assembly 224 and engagement of gear teeth 288 to rack portion 302.

Figure 12:
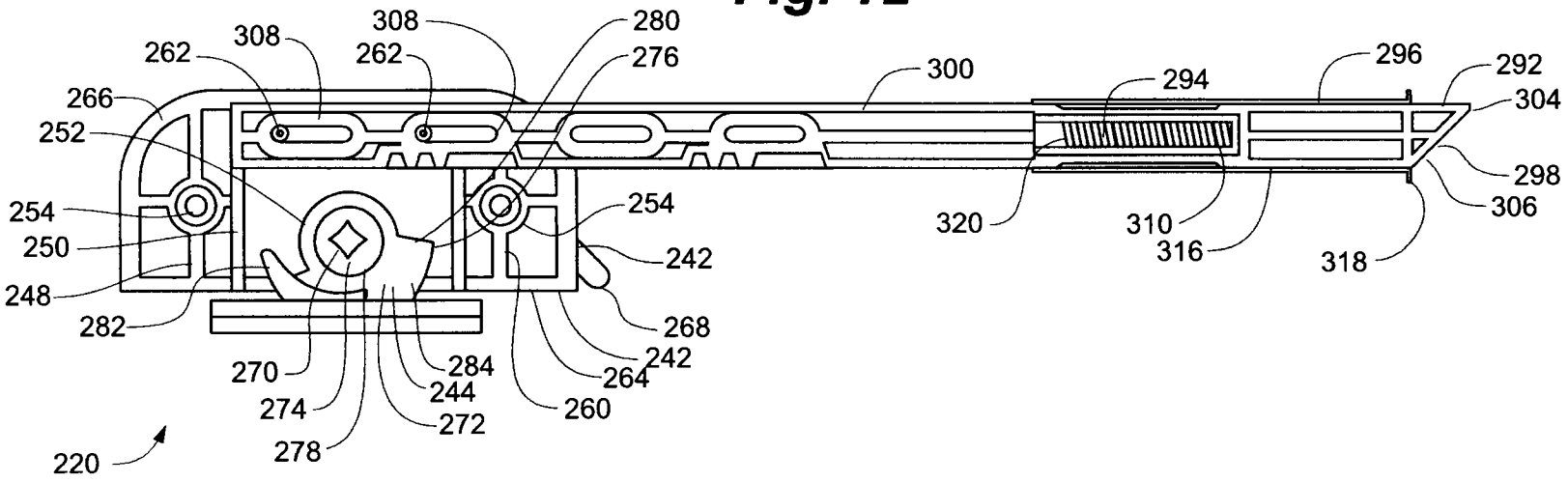
FIG. 12 is a bottom plan view of the integrated lock and latch device of FIG. 11 in a locked position.

Referring particularly to FIG. 12, when lock assembly 222 is in the locked position, handle 268 is generally parallel to lock rail 236 and lock rail 238. Sweep cam 272 is engaged to keeper 226 so that sweep cam 272 is received into opening 334 surrounded by cam receiving arch 332. Cam engaging boss 336 engages upwardly extending ridge 286 of cam plate 284 thus impeding the jimmying of lock assembly 222 from keeper 226. As can be seen particularly in FIG. 12, in the locked position, gear teeth 288 of pinion portion 282 are entirely disengaged from rack portion 302 of sliding bolt 292. Thus, sliding bolt 292 is biased by biasing spring 294 outwardly from inner sash 230 so that latch portion 298 protrudes beyond bolt housing 296. Thus, latch portion 298 is engaged to side jamb 240 preventing inner sash 230 from being tilted inward.

Figure 13:
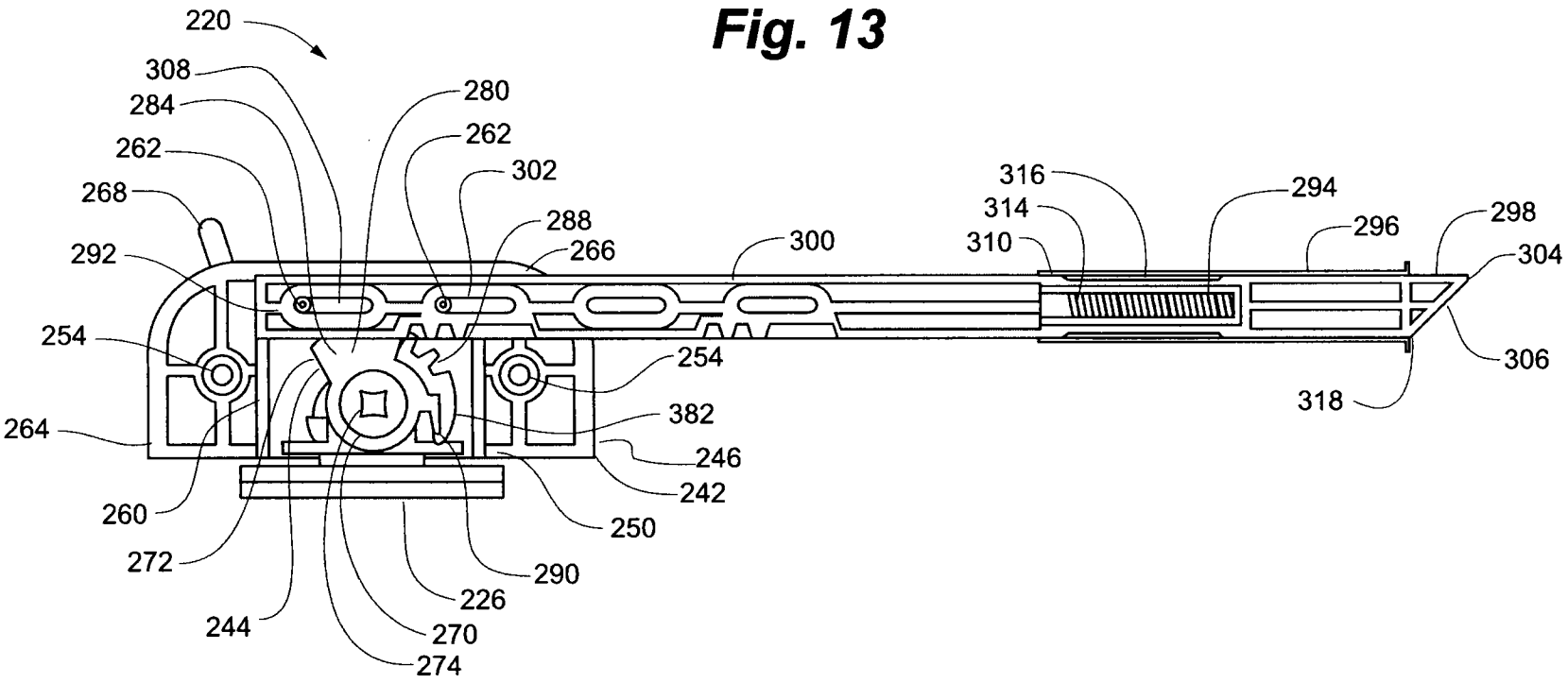
FIG. 13 is a bottom plan view of the integrated lock and latch device of FIG. 11 in an unlocked position.

Referring particularly to FIG. 13, when lock assembly 222 is in the unlocked position, handle 268 is oriented generally oblique to lock rail 236 and lock rail 238. Sweep cam 272 is disengaged from keeper 226, thereby enabling relative movement of inner sash 230 and outer sashes 232.

In the unlocked position, gear teeth 288 of pinion portion 282 are disengaged from rack portion 302 of sliding bolt 292, but are located near to and with a single gear tooth 288 nearly engaged to rack portion 302. Biasing spring 294 maintains sliding bolt 292 in a position relative to bolt housing 296 so that latch portion 298 extends outwardly from bolt housing 296. Thus, in this orientation, latch portion 298 is still engaged to side jamb 240 preventing inner sash 230 from being tilted inward.

Figure 14:
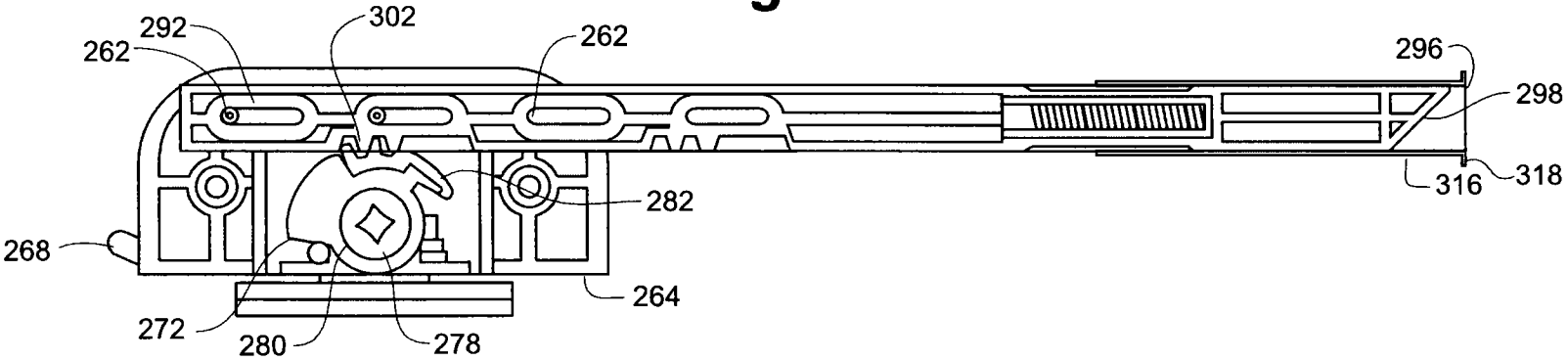
FIG. 14 is a bottom plan view of the integrated lock and latch device of FIG. 11 in a tilt position.
Figure 15:
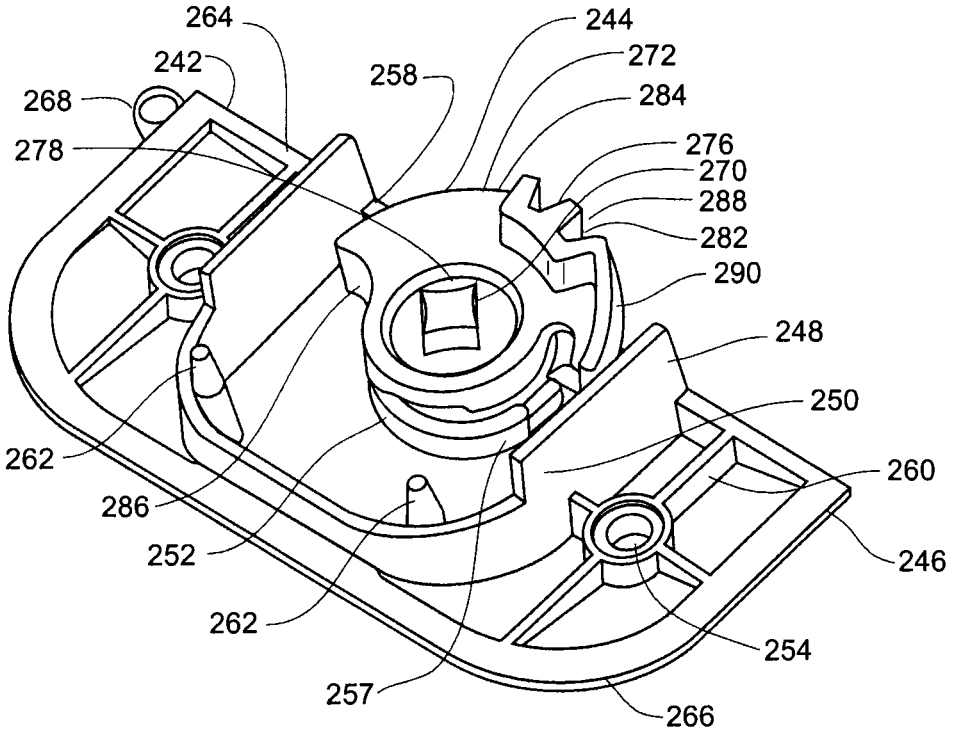
FIG. 15 is a bottom isometric view of the lock assembly portion of the lock assembly of FIG. 11.
Figure 16:
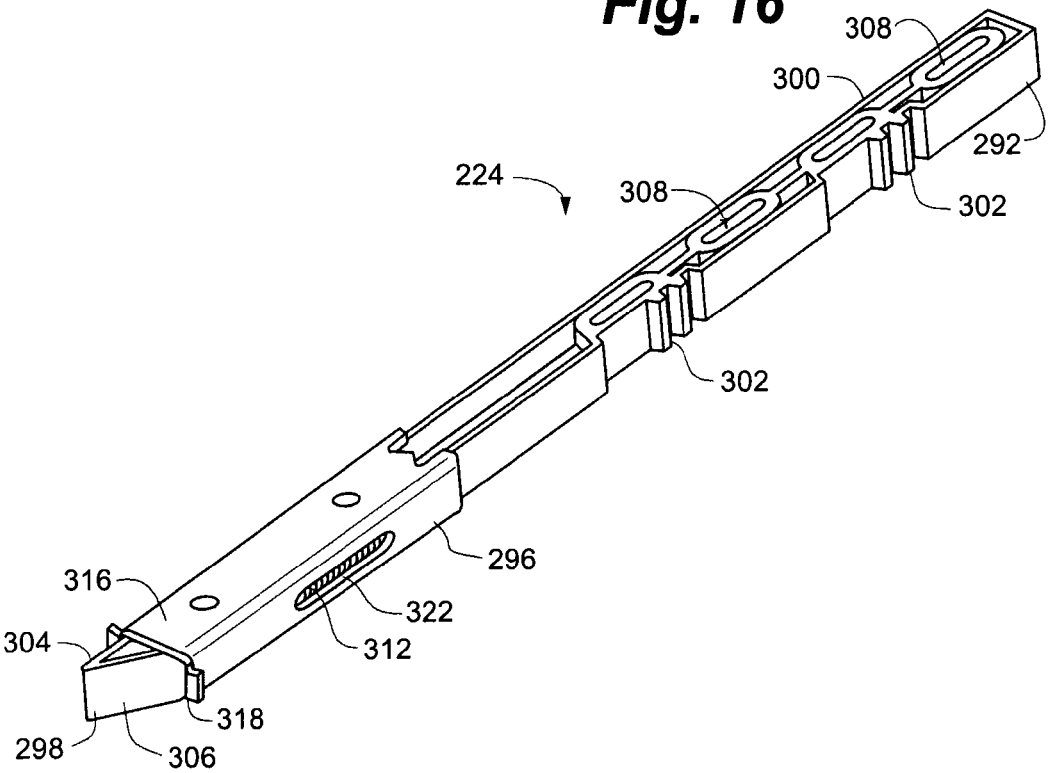
FIG. 16 is an isometric view of the latch assembly of the device of FIG. 11.

Referring particularly to FIG. 14, in the tilt position, handle 268 is again generally parallel to lock rail 236 and lock rail 238 but is oriented approximately 180° differently from the locked position depicted in FIG. 12. Sweep cam 272 is still completely disengaged from keeper 226.

As can be seen particularly in FIG. 14, in the tilt position, gear teeth 288 of pinion portion 282 are engaged to rack portion 302 of sliding bolt 292 and have caused sliding bolt 292 to be withdrawn within bolt housing 296. Tail portion 290 abuts rack portion 302 preventing further rotation of pinion portion 282 and further retraction of sliding bolt 292. Thus, latch portion 298 of sliding bolt 292 is withdrawn into bolt housing 296 while biasing spring 294 is compressed, thus withdrawing latch portion 298 from engagement to side jamb 240. This frees inner sash 230 to be tilted inwardly out of parallel alignment with side jamb 240. This permits access to the exterior of inner sash 230 for cleaning or other activities.

When handle 268 is released, biasing spring 294 again extends latch portion 298 of sliding bolt 292 beyond inner sash 230 so that latch portion 298 protrudes beyond bolt housing 296. At the same time, handle 268 returns to the unlocked position by the combined biasing force of biasing spring 294 and detent spring 256.

Integrated lock and latch device 220 of the present invention provides a number of benefits and advantages. Assembly of lock assembly 222 to tilt latch assembly 224, via engagement of alignment slots 308 and alignment pegs 262, provides easy direct alignment of the two assemblies relative to each other.

Sliding bolt 292 is pre-tensioned relative to bolt housing 96. This helps provides positive placement of tilt latch assembly 224 relative to lock assembly 222. Alignment slots 308 are tapered on sliding bolt 292 to help provide positive and easy self alignment with alignment pegs 262 on lock assembly 222. Alignment pegs 262 are also tapered.

Because of the presence of multiple rack portions 302 on sliding bolt 292, a single tilt latch assembly 224 is able to handle a variety of lock assembly 222, set-back positions on inner sash 230.

Direct interface of pinion portion 282 with rack portion 302 eliminates the need for intermediate elements connecting lock assembly 222 to tilt latch assembly 224. This makes assembly of integrated lock and latch device 220 of the present invention quicker and easier.

The direct interface of pinion portion 282 of sweep cam 272 with rack portion 302 minimizes play and tolerance build-up between lock assembly 222 and tilt latch assembly 224. Bolt housing 296 of tilt latch assembly 224 does not require additional retention features to prevent it from coming out inner sash 230. Assembly of lock assembly 222 to tilt latch assembly 224 and the action of biasing spring 294 prevents bolt housing 296 from unintentionally coming out of inner sash 230. This aspect of integrated lock and latch device 220 also makes assembly quicker and easier.

In the event that inner sash 230 has a hollow structure, interior insert 338 is inserted into inner sash 230 prior to the insertion of tilt latch assembly 224 and lock assembly 222. Alternately, tilt latch assembly 224 may be inserted into interior insert 338 and then the assembled interior insert 338 and tilt latch assembly 224 may be inserted into inner sash 230 together. Tilt latch conforming portion 342 at least partially surrounds and supports tilt latch assembly 224 in relation to lock assembly 222. Sash member conforming portion 140 abuts interior surfaces of inner sash 30 and thus provides solid support to tilt latch assembly 24.

As depicted in FIGS. 34-56, integrated lock and latch device 420 according to an embodiment generally includes lock assembly 422, tilt latch assembly 424 and keeper 426. Integrated lock and latch device 420 is adapted to be used in a double hung window 428, generally including inner sash 430, outer sash 432 and frame 434. Integrated lock and latch device 420 is adapted to be used in other sliding sash windows as well. Inner sash 430 and outer sash 432 are slidably engaged with frame 434. In this exemplary embodiment, inner sash 430 includes lock rail 436 at a top thereof and outer sash 432 includes lock rail 38 at a lower edge thereof. Frame 434 also presents side jamb 440.

Lock assembly 422 generally includes housing 442 and sweep cam assembly 444. Housing 442 is a generally unitary structure including mounting plate 446, bosses 448, wall 450 and sweep cam support 452. As can be seen, bosses 448 and wall 450 extend downwardly from mounting plate 446. Sweep cam support 452 has a generally annular structure and also extends downwardly from mounting plate 446 and defines shaft opening 453. Mounting plate 446 presents fastener holes 454 for receiving fasteners such as screws (not shown).

Sweep cam support 452 partially supports detent spring 456. Sweep cam support 452 presents detent spring notches 458 into which detent spring 456 fits. Mounting plate 446 may be formed as a casting or molding and may present reinforcing ridges 460 on a bottom side thereof.

Wall 450 may present alignment pegs 462. Housing 442 may include flat edge 464 and curved edge 466 forming its perimeter.

Sweep cam assembly 444 generally includes handle 468, shaft 470 and sweep cam 472. Handle 468 is coupled to sweep cam 472 by shaft 470. In the depicted exemplary embodiment, shaft 470 passes through mounting plate 446 and within sweep cam support 452 via shaft opening 453. Shaft 470 has a generally square cross section where it engages sweep cam 472 and a generally circular cross section where it passes through shaft opening 453. Handle 468 is generally conventional in design and may be formed as an integral structure with shaft 470. Shaft 470, viewed in cross section, may present concave faces 474 or have a truly square cross section.

Sweep cam 472 generally includes body 476, presenting shaft portion 478, cam portion 480 and pinion portion 482. Shaft portion 478 is structured generally to engage shaft 470 by receiving shaft 470 therein and has a complementary shape to shaft 470. Shaft portion 478 also defines detents 483. Cam portion 480 extends outwardly away from shaft portion 478 and presents upwardly extending ridge 486 on a top side thereof. Pinion portion 482 extends generally downwardly from cam portion 480 and presents gear teeth 488 and tail portion 490. In the depicted embodiment, gear teeth 488 include two individual gear teeth 488 and tail portion 490 has a generally arcuate shape. This should not be considered limiting.

Tilt latch assembly 424 generally includes latch assembly 492, linking member 494 and drive member 496.

Latch assembly 492 generally includes sliding bolt 498, biasing spring 500 and bolt housing 502. Sliding bolt 498 is received in bolt housing 502 and is biased toward a latched position by biasing spring 500. Biasing spring 500 may be a compression spring as depicted, but can include other springs known to those of skill in the art.

Latch assembly 492 is structured to be in inserted into a drilled or routed opening in lock rail 436 of inner sash 430. Latch assembly 492 is coupled to drive member 496 by linking member 494. Drive member 496 engages at pinion portion 482 of sweep cam 472.

Sliding bolt 498 generally includes external portion 504, housing portion 506 and linking portion 508. When assembled, external portion 504 extends outwardly from bolt housing 502. External portion 504 generally presents straight side 510 and angle side 512. Linking portion 508 extends inwardly from bolt housing 502. Linking portion 508 presents linking member receiver 514. Linking member receiver 514 generally includes side walls 516, which define entry trough 518, engaging groove 520 and recessed sides 522. Linking member receiver 514 also defines engaging aperture 524.

Linking member 494 includes elongate portion 526, first bent portion 528 and second bent portion 530. Linking member 494 may be formed of wire of an appropriate stiffness and diameter. Linking member 494 may be of any length appropriate for coupling latch assembly 492 to drive member 496 and may be varied to accommodate many different sizes of inner sash 430. Thus, integrated lock and latch device 420 can accommodate many sizes of inner sashes 430 by only changing the length of linking member 494.

Drive member 496 generally includes linking member engagement portion 532, rack portion 534, alignment slots 536 and tapered end 538. Linking member engagement portion 532 generally includes side walls 540, defining entry trough 542, engaging groove 544, recessed sides 546 and engaging aperture 548. Rack portion 534 generally includes gear teeth 550 and recessed section 552. Gear teeth 550 and recessed section 552 are sized to mate with gear teeth 488 and tail portion 490 of pinion portion 482 of sweep cam 472. Alignment slots 536 are generally equal in size and oriented along a long axis of drive member 496. Alignment slots 536 are sized to receive alignment pegs 462. Drive member 496 may also present strengthening ridges 554 thereon to increase rigidity and save weight and material. Drive member 496 may be formed of molded plastic or other materials known to those skilled in the art.

In some embodiments, particularly when integrated lock and latch device 420 is installed in inner sash 430, lock rail 436 that has a hollow structure such as an aluminum sash, cage 556 assists in installation. In the depicted embodiment, cage 556 is a generally tray shaped structure presenting floor 558, side walls 560 and back wall 562. Conveniently, cage 556 may be made bilaterally symmetrical such that side walls 560 are substantially mirrored images of each other. Side walls 560 generally have support tabs 564 and snap feature 565. Support tabs 564 include side tabs 566 and corner tabs 568. Side walls 560 are joined to back wall 562 by corner arches 570. Corner arches 570 along with side walls 560 and back wall 562 define corner openings 572. Corner openings 572 are sized to receive drive member 496 therethrough. Snap feature 565 generally presents teeth 571 and wedge 573. Cage 556 is dimensioned to receive bosses 448 of housing 442 therein in close fitting relation. Back wall 562 supports integral back wall wedges 574 thereon. Back wall wedges 574 are substantially mirror images of each other.

Floor 558 supports arcuate walls 576. Arcuate walls 576 extend generally upward from floor 558 and present concave side 578 and convex side 580. Arcuate walls 576 are positioned a distance from back wall 562 to accommodate drive member 496.

Biasing spring 500 can be another type of spring or biasing member known to those skilled in the art as well.

Keeper 426 generally includes mounting portion 582 and cam receiving portion 584. Mounting portion 582 and cam receiving portion 584 are generally part of a unitary structure. Mounting portion 582 generally includes plate 586 presenting fastening holes 588 passing therethrough. Cam receiving portion 584 generally includes cam receiving arch 590 surrounding opening 592 into which extends cam engaging boss 594. Keeper 426 in the depicted embodiment is generally conventional in structure. Keeper 426 may be formed of metal, plastic, composite materials or other materials known to those skilled in the art.

A feature of the depicted embodiment is that a lower edge of cam receiving portion 484 extends outwardly toward lock assembly 422, a relatively greater distance than prior art keeper designs. This feature creates a smaller gap between components so as to improve resistance to picking and thus greater forced entry resistance (FER), and also a larger support surface for the bottom of sweep cam 472 to help reduce cam rollout during impact and during impact testing.

Detent spring 456 is a generally circular shaped structure. Detent spring 456 generally includes inner annulus 596 and outer annulus 598. Inner annulus 596 is generally flat in nature while outer annulus 598 includes structures extended out of its plane. Inner annulus 596 and outer annulus 598 are generally concentric. Outer annulus 598 presents tabs 600 and detent ridges 602. Detent ridges 602 are generally v-shaped structures extending out of the plane of outer annulus 598. Detent ridges are sized to engage detents 483. Tabs 600 in the depicted embodiment extend generally out of the plane of outer annulus 598 in a direction opposite to that of detent ridges 602.

Bolt housing 502 in the depicted embodiment generally includes cylindrical body 604 having resilient retainers 606 and flange 608. Resilient retainers 606 are structured to engage a drilled or routed opening into which bolt housing is inserted. Flange 608 is sized to be larger than the opening to prevent cylindrical body 604 from being forced into the opening too deeply.

In operation, lock assembly 422 and tilt latch assembly 424 are secured into lock rail 436 of inner sash 430. Lock assembly 422 may be fitted into a routed space in inner sash 430 on lock rail 436 in a wooded sash. Tilt latch assembly 424 may be inserted into a passage drilled or routed in lock rail 436. Keeper 426 is secured, typically by fasteners, to lock rail 438 of outer sash 432. When lock assembly 422 is assembled, alignment pegs 462 of lock assembly 422 are engaged to alignment slots 536 of drive member 496. Pinion portion 482 of sweep cam 472 engages rack portion 534 of drive member 496.

Linking member 494 is coupled to drive member 496 by inserting one of first bent portion 528 and second bent portion 530 into linking member receiver 514. Linking member 494 is coupled to latch assembly 492 by inserting the other of first bent portion 528 and second bent portion 530 into linking member engagement portion 532 of latch assembly 492. Elongate portion 526 of linking member 494 is then gripped by side walls 516 while first bent portion 528 is received in engaging aperture 524. The other end of elongate portion 526 is gripped by side walls 540 while second bent portion 530 is received into engaging aperture 548. Handle 468 is inserted into housing 442 so that sweep cam 472 is engaged to shaft 470.

In use, handle 468 is shiftable among a lock position, an unlocked position and a tilt position. As handle 468 is shifted between the locked and unlocked positions, sweep cam 472 is rotated to disengage it from keeper 426. As handle 468 is shifted between the unlocked position and the tilt position, pinion portion 482 of sweep cam 472 engages rack portion 534 of drive member 496. Drive member 496 then places tension on linking member 494 drawing it toward lock assembly 422. Linking member 494 in turn places tension on sliding bolt 498 which is retracted into bolt housing 502, thus releasing inner sash 430 from frame 434 allowing inner sash 430 to be titled inward for cleaning the exterior of inner sash 430 or for other reasons.

When sweep cam 472 is engaged to keeper 426, sweep cam 472 is engaged into opening 592 formed by cam receiving arch 590. Cam engaging boss 594 engages upwardly extending ridge 486 of cam plate 484 thus inhibiting the jimmying of lock assembly 422 from keeper 426.

When handle 468 is released, biasing spring 500 returns sliding bolt 498 to its extended position. At the same time, handle 468 returns to the unlocked position, by the combined bias of biasing spring 500 and detent spring 456.

The length of linking member 594 can be varied to accommodate many different sash sizes. Only the length of linking member 594 need be varied to do so.

The foregoing descriptions present numerous specific details that provide a thorough understanding of various embodiments of the invention. It will be apparent to one skilled in the art that various embodiments, having been disclosed herein, may be practiced without some or all of these specific details. In other instances, components as are known to those of ordinary skill in the art have not been described in detail herein in order to avoid unnecessarily obscuring the present invention. It is to be understood that even though numerous characteristics and advantages of various embodiments are set forth in the foregoing description, together with details of the structure and function of various embodiments, this disclosure is illustrative only. Other embodiments may be constructed that nevertheless employ the principles and spirit of the present invention. Accordingly, this application is intended to cover any adaptations or variations of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. An integrated lock and latch device for use in sliding sash windows, comprising:

a lock assembly including a sweep cam rotatably supported by a housing, the sweep cam having a pinion portion adjacent thereto and extending downwardly therefrom, the pinion portion presenting first gear teeth extending outwardly therefrom;

a tilt latch assembly including a sliding bolt, the sliding bolt being biased toward an extended position wherein a terminal portion of the sliding bolt extends outwardly, the sliding bolt presenting a pair of spaced apart integrally formed rack portions, each rack portion presenting a set of second gear teeth, wherein each of the rack portions is selectively engagable with the pinion portion of the sweep cam upon installation of the lock assembly so that the sliding bolt can be disposed in either of two different positions relative to the sweep cam; and a keeper;

wherein the sweep cam is rotatably shiftable between a locked position proximate a first limit of rotational travel wherein the sweep cam is engaged to the keeper an intermediate unlocked position wherein the sweep cam is disengaged from the keeper, and a tilt position proximate a second limit of rotational travel wherein the sweep cam is disengaged from the keeper and the first gear teeth are engaged with the second gear teeth of a selected one of the pair of rack portions, and the sliding bolt is withdrawn inwardly from the extended position.

2. The integrated lock and latch device of claim 1, wherein the tilt latch assembly includes a housing, the sliding bolt being slidably disposed in the housing.

3. The integrated lock and latch device of claim 2, wherein the tilt latch assembly includes a biasing spring arranged to bias the sliding bolt toward the extended position.

4. The integrated lock and latch device of claim 1, wherein the keeper includes a cam receiving portion defining a cam receiving opening, wherein a portion of the sweep cam is received in the cam receiving opening when the sweep cam is engaged to the keeper, and wherein a lower edge of the cam receiving portion extends under the sweep cam when the sweep cam is received in the cam receiving opening.

5. The integrated lock and latch device of claim 1, further comprising a handle operably coupled to the sweep cam for rotating the sweep cam relative to the housing.

6. A window assembly comprising:

a frame;

an upper sash disposed in the frame;

a lower sash slidably and tiltably disposed in the frame; and an integrated lock and latch device comprising:

a lock assembly on the lower sash including a sweep cam rotatably supported by a housing, the sweep cam having a pinion portion adjacent thereto and extending downwardly therefrom, the pinion portion presenting first gear teeth extending outwardly therefrom;

a tilt latch assembly including a sliding bolt, the sliding bolt being biased toward an extended position wherein a terminal portion of the sliding bolt extends outwardly, the sliding bolt presenting a pair of spaced apart integrally formed rack portions, each rack portion presenting a set of second gear teeth, wherein each of the rack portions is selectively engagable with the pinion portion of the sweep cam upon installation of the lock assembly so that the sliding bolt can be disposed in either of two different positions relative to the sweep cam; and a keeper;

wherein the sweep cam is rotatably shiftable between a locked position proximate a first limit of rotational travel wherein the sweep cam is engaged to the keeper to lock the lower sash to the upper sash keeper, an intermediate unlocked position wherein the sweep cam is disengaged from the keeper so as to enable the lower sash to slide in the frame, and a tilt position proximate a second limit of rotational travel wherein the sweep cam is disengaged from the keeper and the first gear teeth are engaged with the second gear teeth of a selected one of the pair of rack portions, and the sliding bolt is withdrawn inwardly from the extended position to enable the lower sash to tilt relative to the frame.

7. The window assembly of claim 6, wherein the tilt latch assembly includes a housing, the sliding bolt being slidably disposed in the housing.

8. The window assembly of claim 7, wherein the tilt latch assembly includes a biasing spring arranged to bias the sliding bolt toward the extended position.

9. The window assembly of claim 6, wherein the keeper includes a cam receiving portion defining a cam receiving opening, wherein a portion of the sweep cam is received in the cam receiving opening when the sweep cam is engaged to the keeper, and wherein a lower edge of the cam receiving portion extends under the sweep cam when the sweep cam is received in the cam receiving opening.

10. The window assembly of claim 6, further comprising a handle operably coupled to the sweep cam for rotating the sweep cam relative to the housing.

* * * * *